US005593816A

United States Patent [19]

Takizawa et al.

[11] Patent Number: 5,593,816

[45] Date of Patent: Jan. 14, 1997

[54] SILVER HALIDE COLOR PHOTOGRAPHIC MATERIAL AND COLOR IMAGE FORMING METHOD

[75] Inventors: Hiroo Takizawa; Toshiyuki Makuta, both of Kanagawa, Japan

[73] Assignee: Fuji Photo Film Co., Ltd., Kanagawa, Japan

[21] Appl. No.: 178,884

[22] Filed: Jan. 7, 1994

[30] Foreign Application Priority Data

Jan. 11, 1993 [JP] Japan ..... 5-017836
Jul. 16, 1993 [JP] Japan ..... 5-197673

[51] Int. Cl.[6] ..... G03C 7/42

[52] U.S. Cl. ..... 430/393; 430/430; 430/460; 430/461; 430/546

[58] Field of Search ..... 430/385, 387, 430/546, 607, 611, 393, 430, 460, 461

[56] References Cited

U.S. PATENT DOCUMENTS 4,562,146 12/1985 Masuda et al. ..... 430/546
4,882,267 11/1989 Hirabayashi et al. ..... 430/546
4,898,811 2/1990 Wolff et al. ..... 430/546
5,256,526 10/1993 Suzuki et al. ..... 430/385
5,292,630 3/1994 Shimada et al. ..... 430/385

FOREIGN PATENT DOCUMENTS 0309160 3/1989 European Pat. Off. ..... G03C 7/26
0309158 3/1989 European Pat. Off. ..... G03C 7/26
0309159 3/1989 European Pat. Off. ..... G03C 7/26
0147009 3/1981 Germany ..... 430/546

*Primary Examiner*—Hoa Van Le
*Attorney, Agent, or Firm*—Sughrue, Mion, Zinn, Macpeak & Seas

[57] ABSTRACT

A silver halide color photographic material which comprises a support having thereon at least one layer containing at least one compound represented by the following general formula $$R^1—SO_2NH_2$$

wherein $R^1$ represents an unsubstituted aliphatic group having 6 or more carbon atoms, an unsubstituted aryl group or an aryl group substituted by at least one substituent selected from the group consisting of an aliphatic group, an aryloxy group, a carbamoyl group, an acylamino group, an aliphatic oxycarbonyl group, an arylcarbonyl group and a halogen atom, provided that $R^1$ does not contain any coupler residue.

18 Claims, No Drawings

SILVER HALIDE COLOR PHOTOGRAPHIC MATERIAL AND COLOR IMAGE FORMING METHOD

FIELD OF THE INVENTION

This invention relates to a silver halide color photographic material, and more particularly to a silver halide color photographic material which includes a silver halide emulsion containing a nondiffusion coupler capable of forming a nondiffusion dye and forms a color image when processed with a processing solution having a bleaching ability after being processed with a color developing solution containing an aromatic primary amine color developing agent. The present invention also relates to a color image forming method.

BACKGROUND OF THE INVENTION

Conventionally, difficultly water-soluble photographic useful reagents (e.g., oil-soluble couplers, antioxidation products (e.g., alkylhydroquinones, alkylphenols, chromans, coumarones) for use in preventing fading, color fogging or color mixing, hardening agents, oil-soluble filter dyes, oil-soluble ultraviolet light absorbers, oil-soluble fluorescent brighteners, DIR compounds (e.g., DIR hydroquinones, non-color forming couplers), developing agents, color developing agents, DDR redox compounds, DDR couplers and the like are dissolved in appropriate oil forming agents, that is, high-boiling solvents, the resulting solutions are dispersed in a hydrophilic organic colloid, particularly a gelatin solution, in the presence of a surfactant, and the resulting dispersions are contained in hydrophilic organic colloid layers (e.g., light-sensitive emulsion layers, filter layers, back layers, antihalation layers, interlayers, protective layers). Phthalic ester compounds and phosphoric ester compounds are generally used as high-boiling organic solvents.

Phthalic ester compounds and the phosphoric ester compounds are conventionally widely used as high-boiling organic solvents because they have excellent coupler dispersibility and affinity with colloids such as gelatin, have an excellent effect on the stability and hue of developed dye images and are chemically stable in the photographic materials and are inexpensive.

However, these conventional high-boiling organic solvents (e.g., the phthalic ester compounds and the phosphoric ester compounds) are still insufficient in preventing dye images from being faded by light, heat and humidity and in preventing stain from forming when they are used in current photographic materials for which high performance is required.

The high-boiling organic solvents used in current photographic materials must meet various requirements. For example, they must generally meet such requirements that they are inexpensive, can be easily prepared, have excellent solubility and dispersion stability as photographic reagents, do not have adversely affect developability and photographic characteristics, are excellent in safety, do not pollute the environment, have excellent effects in preventing dye images from being faded and have excellent chemical stability.

Dyes formed from couplers, particularly pyrazoloazole magenta dyes and pyrroloazole cyan dyes tend to be associated in the layers. The maximum absorption wavelengths of the associates thereof are different from those of the dye monomers. When the absorption of the associates is too large, this absorption is unfavorable for color reproducibility.

If the maximum absorption wavelengths of the dyes can be controlled by making the wavelengths longer or shorter by using additives in the same layers as those in which the dyes are present without changing the structures of the dyes themselves, silver halide color photographic materials having better color reproducibility can be prepared with low manufacturing costs.

It has been found that certain compounds of the high-boiling organic solvents capable of being used as dispersion mediums for dye-forming nondiffusion couplers have an effect of making the maximum absorption wavelength of each of yellow, magenta and cyan dyes longer or shorter and an effect of inhibiting or accelerating the association of the dyes to thereby change the absorption wave form. These compounds are drawing attention.

Examples of these compounds include phosphine oxides, phosphinic esters and phosphonic esters described in JP-A-63-301941 (the term "JP-A" as used herein means an "unexamined published Japanese patent application") and JP-A-2-4239, urea compounds described in European Patent 0 309 158 A1, sulfonamide compounds described in European Patent 0 309 159 A1 or JP-A-4-346338 and amide compounds described in European Patent 0 309 160 A1. However, it is often difficult for these compounds to improve the hue of the dyes and at the same time, as dispersion mediums, to improve the solubility and dispersion stability of additives used. Further, the developability of the dye-forming nondiffusion couplers is often reduced. Furthermore, when these compounds and the dye-forming nondiffusion couplers are used in the same layer, the dyes formed from the couplers are often faded by heat, humidity and light.

SUMMARY OF THE INVENTION

An object of the present invention is to provided a silver halide color photographic material which has good color reproducibility, does not fade and is excellent in the developability of the dye-forming nondiffusion couplers.

Another object of the present invention is to provide a silver halide color photographic material which contains a compound with excellent solubility and dispersion stability even when the compound is used as a dispersion medium.

Further object of the present invention is to provide a silver halide color photographic material with excellent color fading prevention effect on an image which is formed by coupling reaction with an oxidation product of an aromatic primary amine color developer.

Still another object of the present invention is to provide an image forming method.

The above-described objects of the present invention are achieved by a silver halide color photographic material which is to be processed with a processing solution having a bleaching ability after imagewise exposure to light and color development, wherein the silver halide color photographic material comprises a support having thereon at least one layer containing at least one compound represented by the following formula (I).

$$R^1—SO_2NH_2 \quad (I)$$

wherein $R^1$ represents an unsubstituted aliphatic group having 6 or more carbon atoms, an unsubstituted aryl group or an aryl group substituted by at least one substituent selected from the group consisting of an aliphatic group, an aryloxy group, a carbamoyl group, an acylamino group, an aliphatic oxycarbonyl group, an aryloxycarbonyl group and a halogen atom provided that $R^1$ does not contain any coupler residue.

Further, the present invention provides an image forming method which comprises image-wise exposing a silver halide color photographic material comprising a support having thereon at least one layer containing at least one compound of formula (I), color developing the photographic material with a solution containing an aromatic primary amine color developing agent, and then processing such with a processing solution having a bleaching ability.

DETAILED DESCRIPTION OF THE INVENTION

It has now been found that when processing is conducted with a color developing solution containing an aromatic primary amine color developing agent and then with a processing solution having a bleaching ability, the compounds of formula (I) can prevent the molecules of yellow dyes, magenta dyes and cyan dyes formed from yellow couplers, magenta couplers and cyan couplers, respectively, from associating, and they have an effect on the maximum absorption wavelength and wave form, whereby color reproducibility, fastness and hue is improved. The present invention has been accomplished on the basis of this finding. Further, it has been found that the compounds of general formula (I) have excellent dispersibility and dispersion stability even when used as dispersion mediums.

The compounds of general formula (I) used in the silver halide color photographic material (hereinafter referred to simply as photographic material) of the present invention are illustrated in greater detail below.

When the substituent groups include an aliphatic moiety, the aliphatic moiety in the present invention may be straight chain, branched chain or cyclic (e.g., cycloalkyl), saturated or unsaturated (e.g., alkenyl) substituted or unsubstituted, unless otherwise stated. Preferably, the aliphatic moiety is an alkyl moiety.

When the substituent groups have an aryl moiety, the aryl moiety in the present invention may be substituted or unsubstituted and may be monocyclic or a fused ring (e.g., phenyl, naphthyl). Preferably, the aryl moiety is a phenyl moiety.

When the substituent groups have a heterocyclic moiety, examples of hetero-atoms in the present invention which form the ring of the heterocyclic moiety include a nitrogen atom, an oxygen atom and a sulfur atom. The ring is preferably a five-membered to eight-membered ring. Substituent groups may be attached to the carbon and nitrogen atoms of the ring, or the ring may be unsubstituted. The ring may be monocyclic or a fused ring.

In the present invention, a group such as an acylamino group, a sulfonamido group, an acyl group, an acyloxy group, a sulfonyl group, a sulfinyl group and a sulfonyloxy group is the group connecting to an aliphatic moiety, an aryl moiety or a heterocyclic moiety.

In the present invention, the number of carbon atoms in a substituent group is the sum total of carbon atoms in all of the substituent groups.

Examples of substituent groups for the aliphatic moiety, the aryl moiety and the heterocyclic moiety include an aliphatic group, an aryl group, an aliphatic oxy group, an aryloxy group, an aliphatic oxycarbonyl group, an aryloxycarbonyl group, an acylamino group, a sulfonamido group, a carbamoyl group, a sulfamoyl group, an alkoxysulfonyl group, a heterocyclic group, an acyl group, an acyloxy group and a halogen atom.

When $R^1$ is an unsubstituted aliphatic group having 6 or more carbon atoms, the number of carbon atoms is preferably 6 to 50, more preferably 8 to 40, still more preferably 12 to 30, particularly preferably 14 to 20, and a straight chain or branched alkyl group is preferred. Examples of unsubstituted aliphatic groups having 6 or more carbon atoms include 2-ethylhexyl, nonyl and dodecyl.

When $R^1$ is an aryl group, the aryl group may be unsubstituted or substituted. When $R^1$ is a substituted aryl group, the aryl group is substituted by at least one selected from the group consisting of an aliphatic group, an aryloxy group, a carbamoyl group, an arylamino group, an aliphatic oxycarbonyl group, an aryloxycarbonyl group and a halogen atom. These substituent groups are illustrated in greater detail below. The aliphatic group is as described above, and is preferably an unsubstituted alkyl group and has preferably 1 to 36 carbon atoms, more preferably 1 to 20 carbon atoms. Examples of typical alkyl groups include methyl, ethyl, t-butyl, t-octyl, nonyl, dodecyl, allyl, cyclohexyl, hexyl, octyl, 3,5,5-trimethylhexyl, i-tridecyl, oleyl and 2-hexyldecyl. Examples of suitable aryloxy groups include phenoxy and 4-methoxyphenoxy. The carbamoyl group is a substituted or unsubstituted carbamoyl group, preferably an alkyl group-substituted carbamoyl group and has preferably 1 to 36 carbon atoms, more preferably 2 to 20 carbon atoms. Examples of typical carbamoyl groups include N-octylcarbamoyl, N,N-dibutoxycarbamoyl and N-phenylcarbamoyl. The acylamino group is a substituted or unsubstituted aliphatic acylamino or arylacylamino group and has preferably 1 to 36 carbon atoms, more preferably 1 to 20 carbon atoms. Examples of suitable acylamino groups include acetamido and benzoylamido. The aliphatic oxycarbonyl group is a substituted or unsubstituted aliphatic oxycarbonyl group and has preferably 2 to 36 carbon atoms, more preferably 2 to 20 carbon atoms. Examples of appropriate alkoxycarbonyl groups include 2-ethylhexyloxycarbonyl, 2-hexyldecyloxycarbonyl and octyloxycarbonyl. The aryloxycarbonyl group is a substituted or unsubstituted aryloxycarbonyl group and has preferably 7 to 42 carbon atoms, more preferably 7 to 26 carbon atoms. Examples of suitable aryloxycarbonyl groups include phenoxycarbonyl and 4-nonylphenoxycarbonyl. Examples of suitable halogen atoms include chlorine atom, bromine atom, iodine atom and fluorine atom.

$R^1$ is preferably a substituted or unsubstituted aryl group, more preferably a substituted aryl group.

Of the compounds of formula (I) used in the present invention, compounds represented by the following formula (II) are particularly preferred.

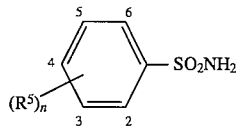

(II)

wherein $R^5$ represents an aliphatic group, an aryloxy group, a carbamoyl group, an acylamino group, an aliphatic oxycarbonyl group, an aryloxycarbonyl group or a halogen atom; and n represents an integer of 1 to 5 and when n is 2 to 5, two or more $R^5$ groups may be the same or different provided that $R^5$ does not contain any coupler residue.

Particularly, when $R^5$ is an aliphatic group, it is preferred that n is 1 and $R^5$ is attached to the 4-position. When $R^5$ is an aliphatic oxycarbonyl group, an aryloxycarbonyl group or a carbamoyl group, it is preferred that n is 1 or 2, and that $R^5$ is attached to the 2-position or the 3-position when n is 1, and $R^5$'s are attached to the 3-position and 5-position when n is 2. When $R^5$ is an acylamino group, it is preferred that n is 1 and $R^5$ is attached to the 2-position or the 3-position.

$R^5$ is preferably an aliphatic group, an aliphatic carbamoyl group, an aliphatic acylamino group or an aliphatic oxycarbonyl group, more preferably an aliphatic carbamoyl group, an aliphatic acylamino group or an aliphatic oxycarbonyl group.

n is preferably 1 or 2, more preferably 2.

In the present invention, at least one of $R^5$'s is preferably attached to the 3-position. More preferably, $R^5$'s are attached to the 3-position and 5-position. When at least one of $R^5$'s is attached to the 3-position, $R^5$ is preferably an aliphatic carbamoyl group, an aliphatic acylamino group or an aliphatic oxycarbonyl group, more preferably an alkylcarbamoyl group or an alkoxycarbonyl group, most preferably an alkoxycarbonyl group.

Specific examples of the compounds of formula (I) which can be used in the present invention include, but are not limited to, the following compounds.

S-1

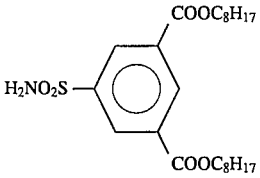

S-2

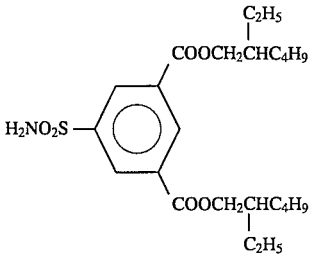

S-3

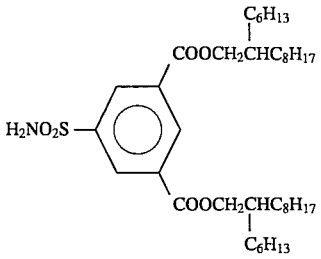

S-4

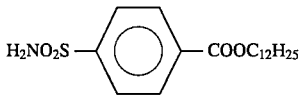

S-5

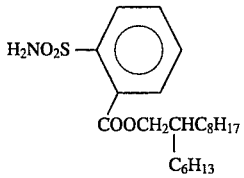

S-6

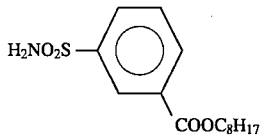

-continued

S-7

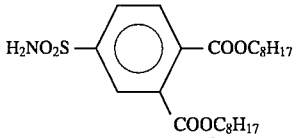

S-8

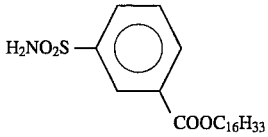

S-9

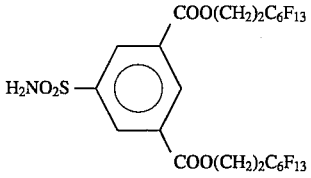

S-10

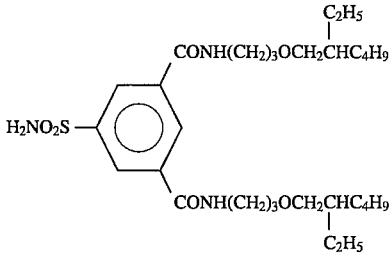

S-11

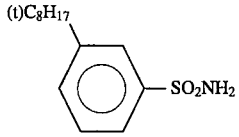

S-12

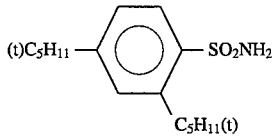

S-13

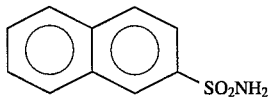

S-14

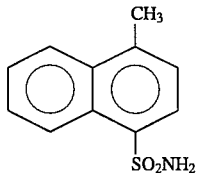

S-15

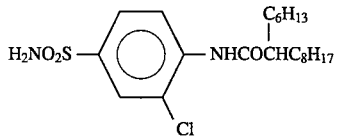

S-16

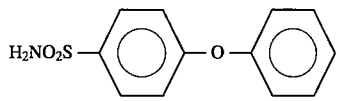

S-17

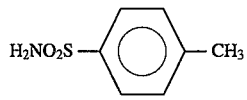

-continued
S-18
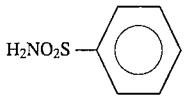
S-19
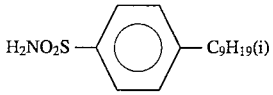
S-20
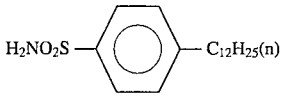
S-21
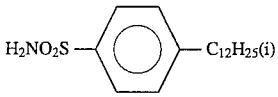
S-22
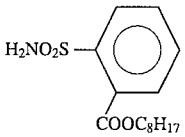
S-23
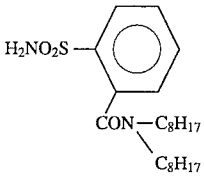
S-24
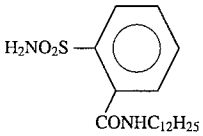
S-25
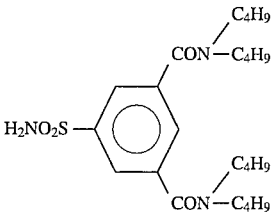
S-26
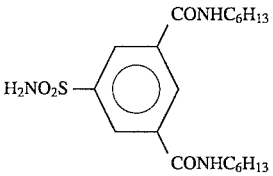
$H_2NO_2SC_8H_{17}$ S-27
$H_2NO_2SC_{12}H_{25}$ S-28
S-29
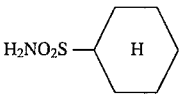
S-30
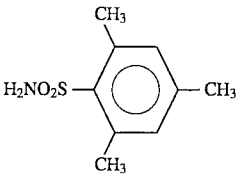
-continued
S-31
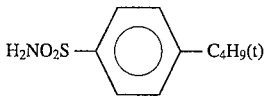
S-32
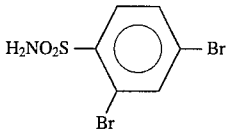
S-33
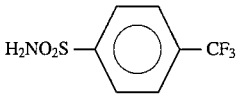
S-34
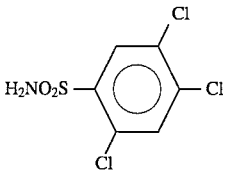
S-35
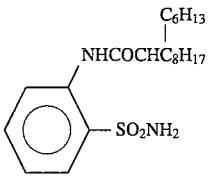
S-36
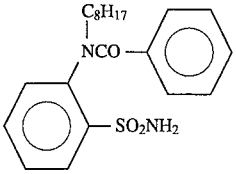
S-37
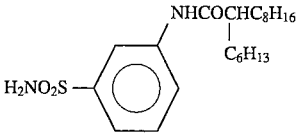
S-38
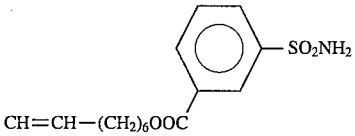
S-39
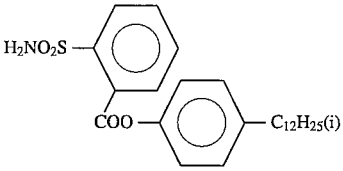
S-40
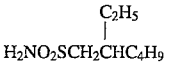

-continued

S-41

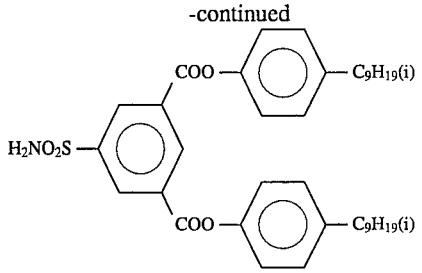

S-42

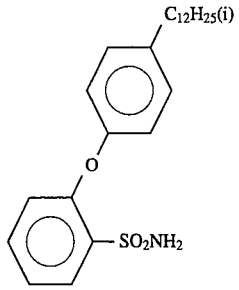

S-43

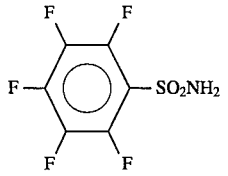

S-44

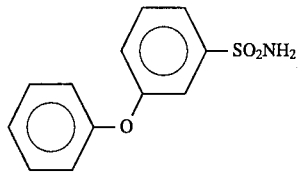

S-45

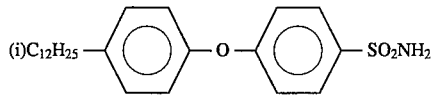

S-46

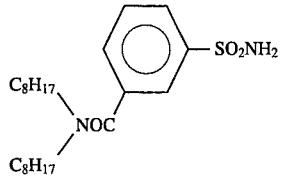

S-47

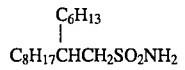

S-48

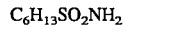

S-49

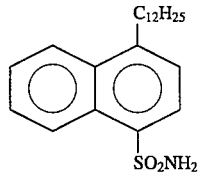

S-50

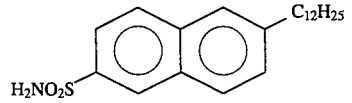

Of them, compound S-1 is preferred.

An example of the synthesis of a sulfonamide compound of the formula (I) which can be used in the present invention is illustrated below. Unless otherwise indicated herein, are parts, percents, ratios and the like are by weight.

Synthesis Example 1 (Synthesis of Compound S-1)

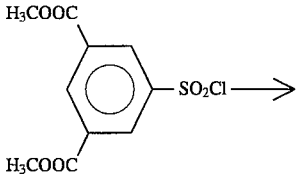

(1)

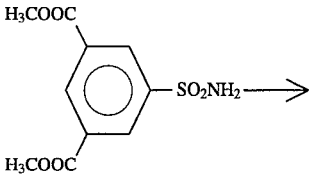

(2)

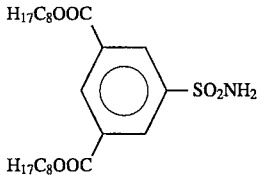

(S-1)

A solution of 70 g (~1.2 mol) of ammonia water (29%) and 100 ml of tetrahydrofuran was stirred under cooling with ice water, and 87.5 g (0.30 mol) of sulfonyl chloride compound (1) was added dropwise thereto over a period of 30 minutes. After stirring for 2 hours at room temperature, the reaction solution was extracted with ethyl acetate and water. The organic phase was washed with diluted hydrochloric acid and water, dried over magnesium sulfate, concentrated and dried to obtain white solid sulfonamide compound (2).

To the obtained sulfonamide compound (2) and 156.2 g (1.2 mol) of 1-octanol, 2.4 ml of concentrated sulfuric acid was added. The solution was stirred at outer temperature of 130° C. for 4 hours with distilling off methanol produced. After distilling off the remaining 1-octanol under reduced pressure, the solution was cooled, extracted with ethyl acetate and sodium hydrogencarbonate aqueous solution. The organic phase was washed with water, dried over magnesium sulfate, concentrated and purified using silica gel column chromatography (elution with ethyl acetate:hexane=1:5 by volume) to obtain white solid Compound S-1.

Yield: 101.4 g (72.0%) with m.p. of 65° C.

NMR and MS spectra and elemental analysis showed that the product was the desired compound.

Synthesis Example 2 (Synthesis of Compound S-21)

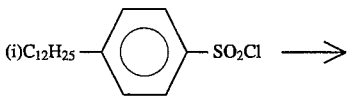

(3)

-continued

Synthesis Example 2 (Synthesis of Compound S-21)

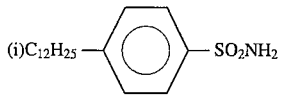

(S-21)

A solution of 35 g (~0.6 mol) of ammonia water (29%) and 50 ml of tetrahydrofuran was stirred under cooling with ice water, and 51.7 g (0.15 mol) of sulfonyl chloride compound (3) was added dropwise thereto over a period of 30 minutes. After stirring for 2 hours at room temperature, the reaction solution was extracted with ethyl acetate and water. The organic phase was washed with diluted hydrochloric acid and water, dried over magnesium sulfate, concentrated and purified using silica gel column chromatography (elution with ethyl acetate:hexane=1:20 by volume) to obtain colorless solution Compound S-21.

Yield: 44.5 g (91.2%)

NMR and MS spectra and elemental analysis showed that the product was the desired compound.

The compounds of formula (I) are present in at least one layer provided on the support. The layer in which the compounds are present may be any of the hydrophilic colloid layers. However, it is preferred that the compounds are present in a silver halide emulsion layer containing at least one dye-forming nondiffusion coupler.

The compounds of formula (I) used in the present invention function mainly as high-boiling organic solvents. The term "high-boiling" as used herein refers to a boiling point of not lower than 175° C. under atmospheric pressure. The amounts of the compounds of formula (I) to be used can vary depending on the purpose without particular limitation. The compounds are used in an amount of preferably 0.0002 to 20 g, more preferably 0.001 to 5 g, per $m^2$ of the photographic material. Usually, the compounds are used in a ratio by weight of the compound:photographic useful reagents of generally from 0.1:1 to 4:1, preferably from 0.1:1 to 2:1.

The compounds of formula (I) are used in a ratio by weight of the compound:the dispersion medium in the dispersion containing the compound and the photographic useful reagents, such as couplers, of from 2:1 to 0.1:1, preferably from 1.0:1 to 0.2:1. A typical example of the dispersion medium is gelatin. Further, hydrophilic polymers such as polyvinyl alcohol can be used as dispersion media. The dispersion of the present invention may contain, in addition to the compounds of formula (I) and the photographic useful reagents, various compounds depending on the objects.

The compounds of formula (I) used in the present invention can be used together with conventional high-boiling organic solvents. When the compounds of formula (I) are used together with conventional high-boiling organic solvents, the compounds of formula (I) are used in an amount of preferably at least 10%, more preferably at least 30%, by weight based on the total amount of the high-boiling organic solvents.

Examples of high-boiling organic solvents which can be used together with the compounds of formula (I) are described in, for example, U.S. Pat. No. 2,322,027. Specific examples of high-boiling organic solvents having a boiling point of 175° C. or higher under atmospheric pressure include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridecyl phosphate, tributoxyethyl phosphate, trichloropropyl phosphate, di-2-ethylhexyl phenyl phosphate), benzoic esters (e.g., 2-ethylhexyl benzoate, dodecyl benzoate, 2-ethylhexyl p-hydroxybenzoate), amides (e.g., N,N-diethyldodecaneamide, N,N-diethyllaurylamide, N-tetradecylpyrrolidone), sulfonamides (e.g., N-butylbenzenesulfonamide), alcohols or phenols (e.g., isostearyl alcohol, 2,4-di-t-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl-2-butoxy-5-t-octylaniline), hydrocarbons (e.g., paraffin, dodecylbenzene, diisopropylnaphthalene) and chlorinated paraffins. Further, organic solvents having a boiling point 30° C. or higher, preferably 50° C. or higher, but 160° C. or lower can be used as co-solvents. Typical examples of organic solvents which can be used as co-solvents include ethyl acetate, butyl acetate, ethyl propionate, methyl ethyl ketone, cyclohexanone, 2-ethoxyethyl acetate and dimethylformamide.

Examples of photographic useful reagents which can be used in the present invention include dye-forming nondiffusion couplers (e.g., yellow couplers, cyan couplers and magenta couplers), antioxidation products (e.g., alkylhydroquinones, alkylphenols, chromans, coumarones) for use in preventing fading, color fogging and color mixing, hardening agents, oil-soluble filter dyes, oil-soluble ultraviolet light absorbers, oil-soluble fluorescent brighteners, DIR compounds (e.g., DIR hydroquinones, non-color forming couplers), developing agents, color developing agents, DDR redox compounds and DDR couplers.

Examples of yellow couplers which can be used in the present invention include those described in U.S. Pat. Nos. 3,933,501, 4,022,620, 4,326,024, 4,401,752 and 4,248,961, JP-B-58-10739 (the term "JP-B" as used herein means an "examined Japanese patent publication"), U.K. Patents 1,425,020 and 1,476,760, U.S. Pat. Nos. 3,973,968, 4,314,023 and 4,511,649, European Patents 249,473A, 446,863A and 447,969A, JP-A-63-23145, JP-A-63-123047, JP-A-1-250944, JP-A-1-213648, JP-A-2-139544, JP-A-3-179042 and JP-A-3-203545.

Magenta couplers which can be used, include 5-pyrazolone compounds and pyrazoloazole compounds. Specific examples of magenta couplers include those described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and WO (PCT) 88/04795.

Cyan couplers which can be used include phenol couplers and naphthol couplers. Examples of phenol and naphthol couplers which can be advantageously used in the present invention include those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199 and JP-A-61-42658. Further, azole couplers described in JP-A-64-553, JP-A-64-554, JP-A-64-555, JP-A-64-556, JP-A-4-333843 and JP-A-5-150426, imidazole couplers described in U.S. Pat. No. 4,818,672 and JP-A-2-33144, imidazole couplers described in JP-A-64-32260 and cyclic active methylene cyan couplers described in JP-A-64-32260 can be used.

It is more preferred that the compounds of formula (I) used in the silver halide color photographic material of the present invention and cyan couplers represented by the following formula (III) or magenta couplers represented by the following formula (IV) in particular among couplers are used in the same layers because the positions of the maximum absorption wavelengths of the dyes and the degree of association peak are greatly affected and color fading property can be greatly improved.

(III)

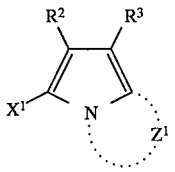

(IV)

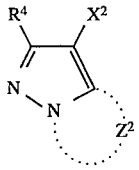

wherein $Z^1$ and $Z^2$ each represents a non-metallic atomic group required for forming an azole ring together with nitrogen atom as the hetero-atom of the ring; $R^2$ and $R^3$ each represents an electron withdrawing group having a Hammett's substituent constant $\sigma_p$ value of at least 0.30; $R^4$ represents a hydrogen atom or a substituent group; $X^1$ and $X^2$ each represents a hydrogen atom or a group which is eliminated by the coupling reaction with the oxidation product of an aromatic primary amine color developing agent.

Examples of the azole ring formed by $Z^1$ and $Z^2$ include the following groups.

(Z-1)

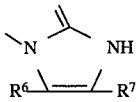

(Z-2)

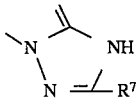

(Z-3)

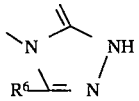

(Z-4)

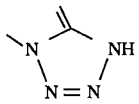

(Z-5)

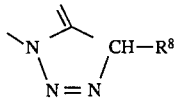

-continued (Z-6)

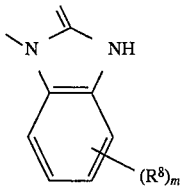

(Z-7)

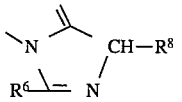

(Z-8)

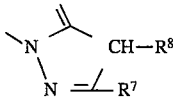

wherein $R^6$, $R^7$ and $R^8$ each represents a hydrogen atom or a substituent group. Preferably, $Z^1$ and $Z^2$ are each a group of the formula Z-2 or Z-3 described above with a group of the formula Z-2 being particularly preferred.

$R^2$ and $R^3$ are each an electron withdrawing group having a Hammett's substituent constant $\sigma_p$ value of at least 0.30, preferably at least 0.40. The upper limit of $\sigma_p$ value of the electron withdrawing group is 1.0 or below. The Hammett's rule is an emprical rule proposed by L. P. Hammett in 1935 to discuss quantitatively the effect of substituent groups on the reaction or equilibrium of benzene derivatives. This rule is widely considered to be appropriate at present. The substituent constant determined by Hammett's rule includes $\sigma_p$ value and $\sigma_m$ value. These values are described in many texts. For example, the details thereof are described in *Lange's Handbook of Chemistry,* the 12th edition, 1979, edited by J. A. Dean (McGraw-Hill) and *Kagaku no Ryoiki* (written in Japanese), special issue, No. 122, pp. 96–103, 1979 (Nanedo). In the present invention, $R^2$ and $R^3$ and are defined by Hammett's substituent constant $\sigma_p$ values. However, it should be understood that substituent groups are not limited to those whose values are already known, but substituent groups whose values are not disclosed in the literature are also within the scope of the present invention, so long as the value is in the range defined above when measured on the basis of Hammett's rule.

Specific examples of electron withdrawing group having a Hammett's substituent constant $\sigma_p$ value of at least 0.30 represented by $R^2$ and $R^3$ include an acyl group (e.g., acetyl, 3-phenylpropanoyl, benzoyl, 4-doecyloxybenzoyl), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, N-{3-(2,4-di-t-amylphenoxy)propyl}carbamoyl), an aliphatic oxycarbonyl group (e.g., methoxycarbonyl, ethoxycarbonyl, isopropyloxycarbonyl, t-butyloxycarbonyl, isobutyloxycarbonyl, butyloxycarbonyl, dodecyloxycarbonyl, octadecyloxycarbonyl), an aryloxycarbonyl group (e.g., phenoxycarbonyl), a cyano group, a nitro group, a sulfinyl group (e.g., 3-phenoxypropylsulfinyl, 3-pentadecylphenylsulfinyl), a sulfonyl group (e.g., methanesulfonyl, octanesulfonyl, benzenesulfonyl, toluenesulfonyl), a sulfonyloxy group (e.g., methanesulfonyloxy, toluenesulfonyloxy), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a trifluoro- or more-fluoroalkyl group (e.g., trifluoromethane, heptafluoropropane) and a perfluoroaryl group (e.g., pentafluorophenyl).

Typical $\sigma_p$ values (as shown in parentheses) of electron withdrawing groups having a $\sigma_p$ value of at least 0.30 are as follows: cyano group (0.66), nitro group (0.78), trifluoromethyl group (0.54), carboxyl group (0.45), acetyl group (0.50), benzoyl group (0.43), trifluoromethanesulfonyl group (0.92), methanesulfonyl group (0.72), benzenesulfonyl group (0.70), methanesulfinyl group (0.49), carbamoyl group (0.36), methoxycarbonyl group (0.45), ethoxycarbonyl group (0.45), phenoxycarbonyl group (0.44), pyrazolyl group (0.37), methanesulfonyloxy group (0.36), dimethoxyphosphoryl group (0.60), sulfamoyl group (0.57), and pentafluorophenyl group (0.41).

In formula (III), $R^2$ and $R^3$ are preferably each a cyano group, an acyl group, a carbamoyl group, an aliphatic oxycarbonyl group or an aryloxycarbonyl group. More preferably, $R^2$ is a cyano group, and $R^3$ is a group of $—CO_2—R^9$ (wherein $R^9$ is an aliphatic group or an aryl group having 1 to 40 carbon atoms, preferably 1 to 30 carbon atoms, more preferably 8 to 30 carbon atoms). Particularly preferably, $R^9$ is a branched alkyl group or a cyclic alkyl group.

$R^4$, $R^6$, $R^7$ and $R^8$ are each a hydrogen atom or a substituent group. Examples of the substituent group include an aryl group (having preferably 6 to 30 carbon atoms such as phenyl, m-acetylaminophenyl, p-methoxyphenyl), an alkyl group (having preferably 1 to 30 carbon atoms such as methyl, trifluoromethyl, ethyl, isopropyl, heptafluoropropyl, t-butyl, n-octyl, n-dodecyl), a cyano group, a formyl group, an acyl group (having preferably 1 to 30 carbon atoms such as acetyl, pivaloyl, benzoyl, furoyl, 2-pyridinecarbonyl), a carbamoyl group (having preferably 1 to 30 carbon atoms such as methylcarbamoyl, ethylcarbamoyl, dimethylcarbamoyl, n-octylcarbamoyl), an aliphatic oxycarbonyl group (having preferably 1 to 30 carbon atoms such as methoxycarbonyl, ethoxycarbonyl, isopropoxycarbonyl, diphenylmethylcarbonyl), an aryloxycarbonyl group (having preferably 7 to 30 carbon atoms such as phenoxycarbonyl, p-methoxyphenoxycarbonyl, m-chlorophenoxycarbonyl, o-methoxyphenoxycarbonyl), a formylamino group, an acylamino group [e.g., an alkylcarbonylamino group having preferably 1 to 30 carbon atoms (e.g., acetylamino, propionylamino, cyanoacetylamino), an arylcarbonylamino group having preferably 7 to 30 carbon atoms (e.g., benzoylamino, p-toluylamino, pentafluorobenzoylamino, m-methoxybenzoylamino), a heterocyclic carbonylamino group having preferably 4 to 30 carbon atoms (e.g., 2-pyridylcarbonylamino, 3-pyridylcarbonylamino, furoylamino)], an aliphatic oxycarbonylamino group (having preferably 2 to 30 carbon atoms such as methoxycarbonylamino, ethoxycarbonylamino, methoxyethoxycarbonylamino), an aryloxycarbonylamino group (having preferably 7 to 30 carbon atoms such as phenoxycarbonylamino, p-methoxyphenoxycarbonylamino, p-methylphenoxycarbonylamino, m-chlorophenoxycarbonylamino), a sulfonamido group (having preferably 1 to 30 carbon atoms such as methanesulfonamido, benzenesulfonamido, p-toluenesulfonamido), a ureido group (having preferably 1 to 30 carbon atoms such as methylureido, dimethylureido, p-cyanophenylureido), a sulfamoylamino group (having preferably 1 to 30 carbon atoms such as methylaminosulfonylamino, ethylaminosulfonylamino, anilinosulfonylamino), an unsubstituted amino group, an alkylamino group (having preferably 10 to 30 carbon atoms such as methylamino, dimethylamino, ethylamino, diethylamino, n-butylamino), an arylamino group (having preferably 6 to 30 carbon atoms such as anilino), an alkoxy group (having preferably 1 to 30 carbon atoms such as methoxy, ethoxy, isopropoxy, n-butoxy, methoxyethoxy, n-dodecyloxy), an aryloxy group (having preferably 6 to 30 carbon atoms such as phenoxy, m-chlorophenoxy, p-methoxyphenoxy, o-methoxyphenoxy), a heterocyclic oxy group (having preferably 3 to 30 carbon atoms such as tetrahydropyranyloxy, 3-pyrrolidyloxy, 2-(1,3-benzimidazolyl)oxy), an alkylthio group (having preferably 1 to 30 carbon atoms such as methylthio, ethylthio, n-butylthio, t-butylthio), an arylthio group (having preferably 6 to 30 carbon atoms such as phenylthio), a heterocyclic thio group (having preferably 3 to 30 carbon atoms such as 2-pyridylthio, 2-(1,3-benzimidazolyl)thio, 1-hexadecyl-1,2,3,4-tetrazolyl-5-thio, 1-(3-N-octadecylcarbamoyl)phenyl-1,2,3,4-tetrazolyl-5-thio), a heterocyclic group (having preferably 3 to 30 carbon atoms such as 2-benzoxazolyl, 2-benzthiazolyl, 1-phenyl-2-benzimidazolyl, 5-chloro-1-tetrazolyl, 1-pyrrolyl, 2-furanyl, 2-pyridyl, 3-pyridyl), a halogen atom (e.g., fluorine, chlorine, bromine), a hydroxyl group, a nitro group, a sulfamoyl group (having preferably 0 to 30 carbon atoms such as methylsulfamoyl, dimethylsulfamoyl, ethylsulfamoyl, N,N-dipropylsulfamoyl), a sulfonyl group (having preferably 1 to 30 carbon atoms such as methanesulfonyl, benzenesulfonyl, toluenesulfonyl, trifluoromethanesulfonyl, difluoromethanesulfonyl), an acyloxy group (having preferably 1 to 30 carbon atoms such as formyloxy, acetyloxy, benzoyloxy), a carbamoyloxy group (having preferably 1 to 30 carbon atoms such as methylcarbamoyloxy, diethylcarbamoyloxy), an imido group (having preferably 4 to 30 carbon atoms such as succinimido, phthalimido), a sulfinyl group (having preferably 1 to 30 carbon atoms such as diethylaminosulfinyl), a phosphoryl group (having preferably 0 to 30 carbon atoms such as dimethoxyphosphoryl, diphenylphosphoryl), a carboxyl group and a phosphono group. These groups may be further substituted, if possible. Preferably, $R^4$, $R^6$ and $R^7$ are each an alkyl group or an aryl group.

Particularly preferably, $R^4$ is a branched alkyl group. More preferably, $R^6$ and $R^7$ are each an aryl group. Still more preferably, $R^6$ and $R^7$ are each an aryl group substituted by at least one of an alkoxy group, an acylamino group, a sulfonamido group and an alkyl group.

$X^1$ and $X^2$ are each a hydrogen atom or a group which is eliminated on coupling with the oxidation product of an aromatic primary amine color developing agent (hereinafter referred to as eliminatable group). Examples of eliminatable groups include a halogen atom (e.g., fluorine, chlorine, bromine), an alkoxy group having 1 to 40 carbon atoms (e.g., ethoxy, dodecyloxy, methoxyethylcarbamoylmethoxy, carboxypropyloxy, methylsulfonylethoxy), an aryloxy group having 6 to 46 carbon atoms (e.g., 4-chlorophenoxy, 4-methoxyphenoxy, 4-carboxyphenoxy), an acyloxy group having 2 to 40 carbon atoms (e.g., acetoxy, tetradecanoyloxy, benzoyloxy), a sulfonyloxy group having 1 to 40 carbon atoms (e.g., methanesulfonyloxy, toluenesulfonyloxy), an acylamino group having 2 to 40 carbon atoms (e.g., dichloroacetylamino, heptafluorobutyrylamino), a sulfonamido group having 1 to 40 carbon atoms (e.g., methanesulfonamido, p-toluenesulfonamido), an aliphatic oxycarbonyloxy group having 2 to 40 carbon atoms (e.g., ethoxycarbonyloxy, benzylcarbonyloxy), an aryloxycarbonyloxy group having 7 to 46 carbon atoms (e.g., phenoxycarbonyloxy), an alkylthio group having 1 to 40 carbon atoms (e.g., carboxymethylthio), an arylthio group having 6 to 40 carbon atoms (e.g., 2-butoxy-5-t-octylphenylthio), a heterocyclic thio group having 1 to 40 carbon atoms (e.g., tetrazolylthio), a carbamoylamino group having 1 to 40 carbon atoms (e.g., N-methylcarbamoylamino, N-phenylcarbamoylamino), a five-membered or six-membered nitrogen-containing heterocyclic group having 1 to 40 carbon atoms (e.g., imidazolyl, pyrazolyl, triazolyl, tetrazolyl, 1,2-dihydro-2-oxo-1 -pyridyl), an imido group having 2 to 40 carbon atoms (e.g., succinimido, hydantoinyl), an aromatic azo group having 6 to 46 carbon atoms (e.g., phenylazo group), a sulfinyl group having 1 to 40 carbon atoms (e.g., 2-butoxy-5-t-octylphenylsulfinyl) and a sulfonyl group having 1 to 40 carbon atoms (e.g., 2-butoxy-5-t-octylphenylsulfonyl).

$X^1$ and $X^2$ are preferably each a halogen atom or an arylthio group.

The couplers of formula (III) or (IV) may be in the form of a dimer or a higher polymer through $R^2$, $R^3$, $R^4$, $R^6$, $R^7$ or $R^8$. The couplers of formula (III) or (IV) may be in the form of a homopolymer or a copolymer where a high molecular weight chain is attached to $R^2$, $R^3$, $R^4$, $R^6$, $R^7$ or $R^8$. Typical examples of homopolymers or copolymers which are formed through a high molecular weight chain include homopolymers of addition polymerizable ethylene type unsaturated compounds having a coupler residue of the formula (III) or (IV) and copolymers thereof. The polymer may comprise one or more repeating units derived from one or more color-forming monomers having coupler residues of general formula (III) or (IV). The copolymer may comprise one or more units derived from one or more members of non-color forming ethylenic monomers such as acrylic esters, methacrylic esters and maleic eaters as comonomers.

Specific examples of the compounds of general formula (III) or (IV) include, but are not limited to, the following compounds.

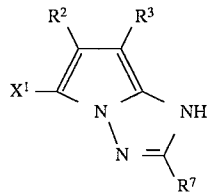
| No. | $R^2$ | $R^3$ | $R^7$ | $X^1$ |
|---|---|---|---|---|
| C-1 | $-CO_2CH_3$ | CN | 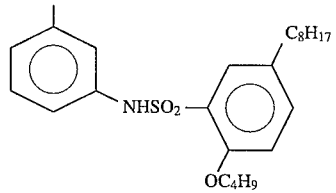 | H |
| C-2 | CN | 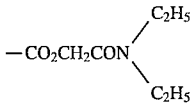 | 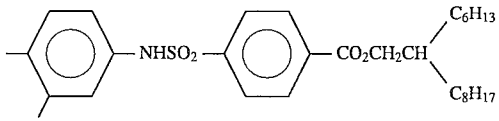 | 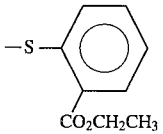 |
| C-3 | CN | 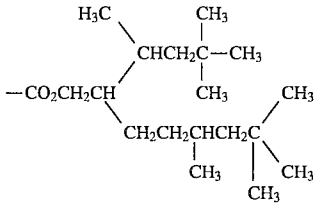 | 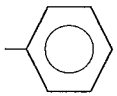 | H |
| C-4 | CN | 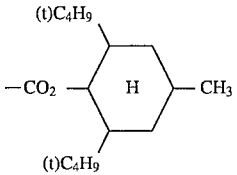 | 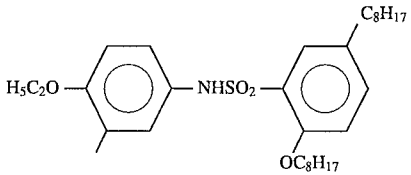 | Cl |

-continued
| | | | | |
|---|---|---|---|---|
| C-5 | CN | 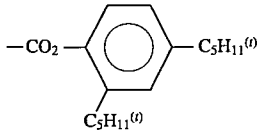 | 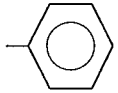 | H |
| C-6 | $CF_3$ | CN | 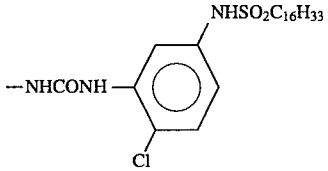 | Cl |
| C-7 | CN | 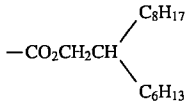 | 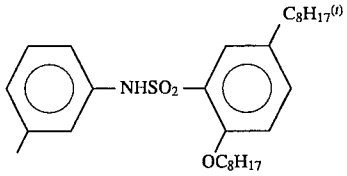 | H |
| C-8 | CN | $-CO_2C_{12}H_{25}$(sec) | 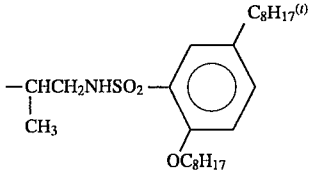 | Cl |
| C-9 | 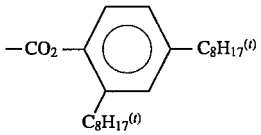 | CN | $-C(CH_3)_3$ | 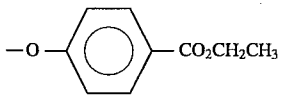 |
| C-10 | CN | $CF_3$ | 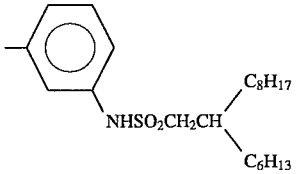 | Cl |

-continued
| | | | | |
|---|---|---|---|---|
| C-11 | CN | 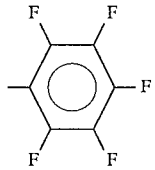 | 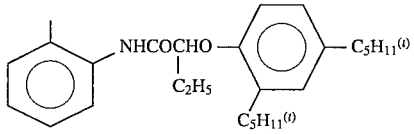 | 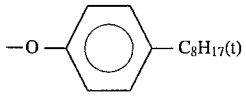 |
| C-12 | CN | 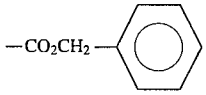 | 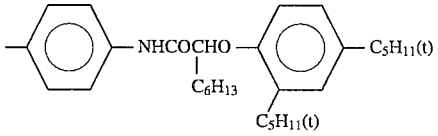 | H |
| C-13 | CN | 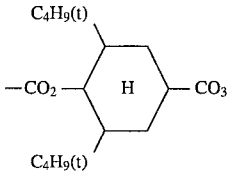 | 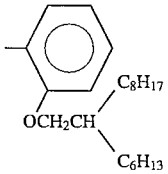 | Cl |
| C-14 | CN | $-CO_2C_4H_9$ | 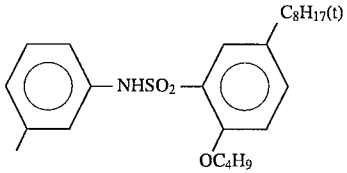 | H |
| C-15 | CN | 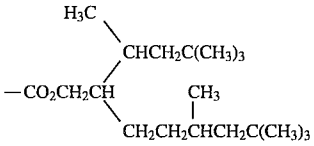 | 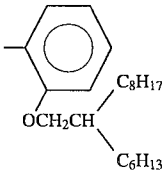 | Cl |
| C-16 | CN | 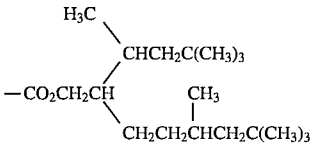 | 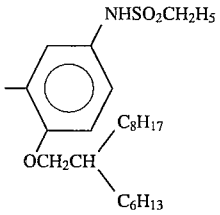 | Cl |

-continued
| | | | | |
|---|---|---|---|---|
| C-17 | CN | $-CO_2CH(CH_3)_2$ | 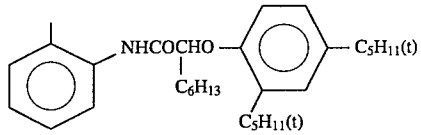 | H |
| C-18 | CN | $-CON(C_2H_5)_2$ | 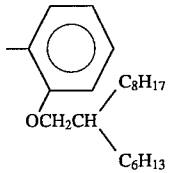 | Cl |
| C-19 | $-CO_2C_2H_5$ | CN | 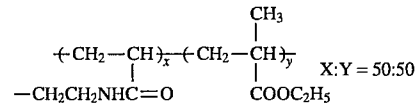 X:Y = 50:50 | Cl |
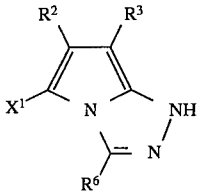
| No. | $R^2$ | $R^3$ | $R^6$ | $X^1$ |
|---|---|---|---|---|
| C-20 | $-CO_2C_2H_5$ | CN | 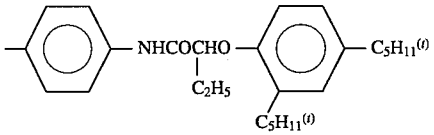 | Cl |
| C-21 | CN | $-CO_2CH_2CH(C_6H_{13})(C_8H_{17})$ | 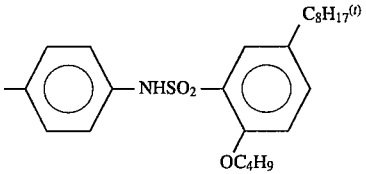 | H |

-continued
| | | | | |
|---|---|---|---|---|
| C-22 | CN | 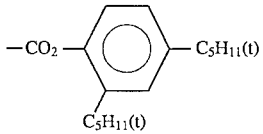 | 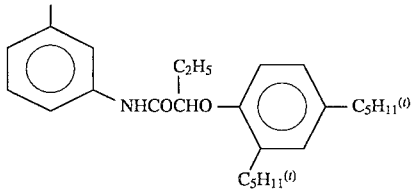 | 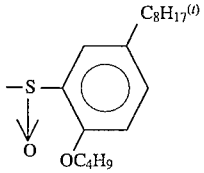 |
| C-23 | $-SO_2CH_3$ | 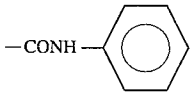 | 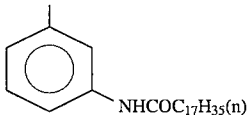 | 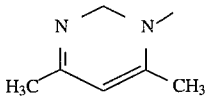 |
| C-24 | $-CO_2C_2H_5$ | $-CO_2C_2H_5$ | 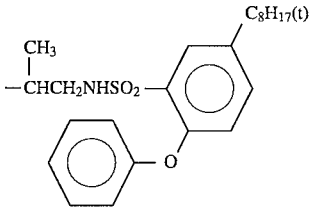 | Cl |

(C-25)
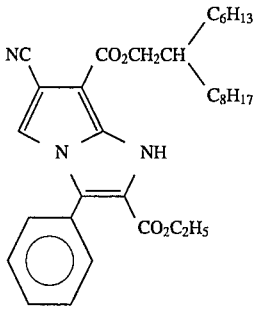
(C-26)
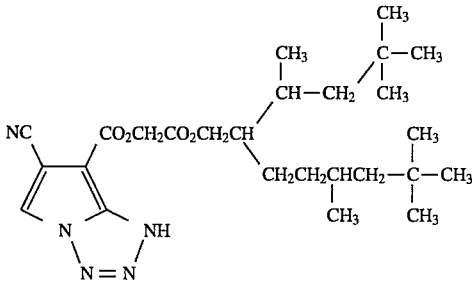
(C-27)
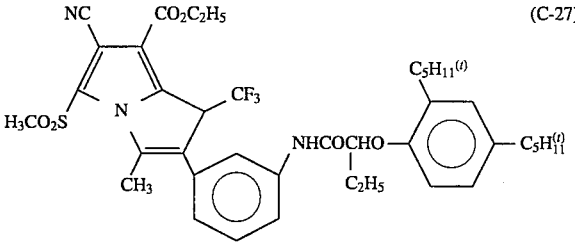
-continued
(C-28)
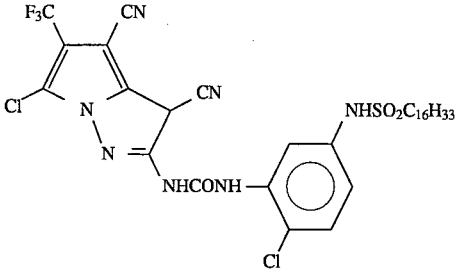
(C-29)
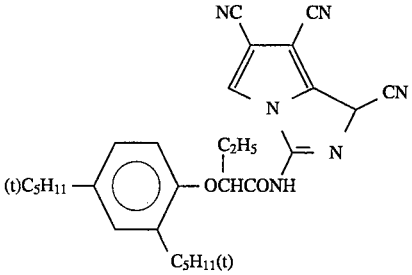
(C-30)
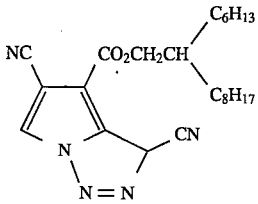
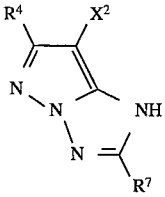
| | $R^4$ | $R^7$ | $X^2$ |
|---|---|---|---|
| M-1 | $CH_3-$ | 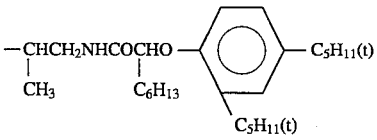 | Cl |
| M-2 | 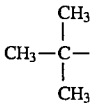 | 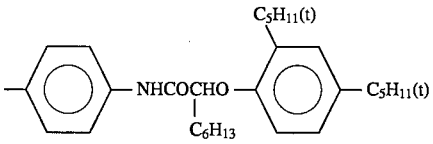 | " |
| M-3 | " | 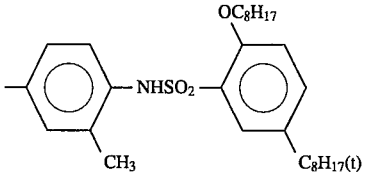 | " |

-continued
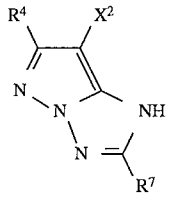
| | $R^4$ | $R^7$ | $X^2$ |
|---|---|---|---|
| M-4 | " | 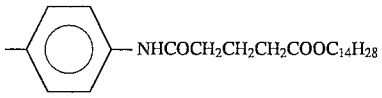 | " |
| M-5 | " | 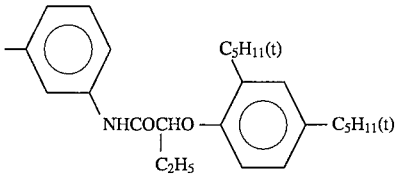 | " |
| M-6 | $CH_3-$ | 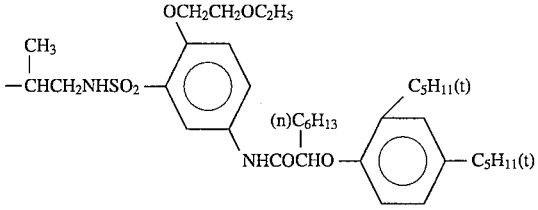 | Cl |
| M-7 | " | 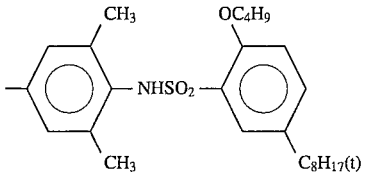 | " |
| M-8 | " | 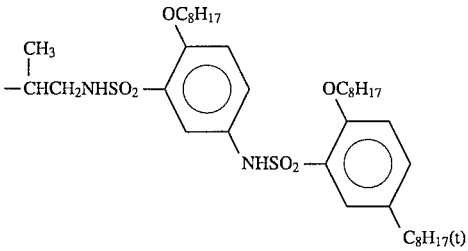 | " |
| M-9 | 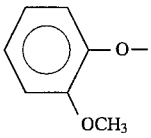 | 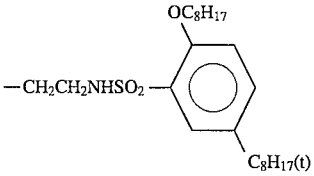 | 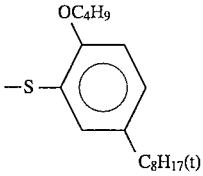 |
| M-10 | $C_2H_5-$ | 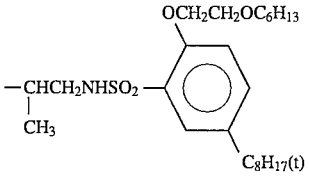 | 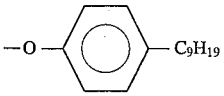 |
| M-11 | 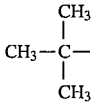 | 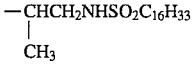 | 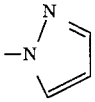 |

-continued
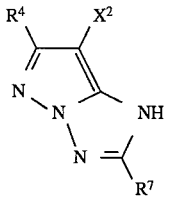
| | $R^4$ | $R^7$ | $X^2$ |
|---|---|---|---|
| M-12 | 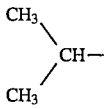 | 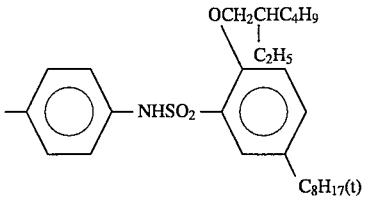 | Cl |
| M-13 | 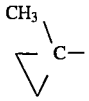 | 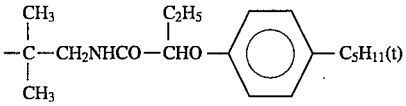 | " |
| M-14 | $C_2H_5O-$ | 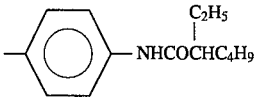 | 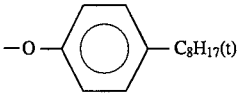 |
| M-15 | $C_2H_5O-$ | 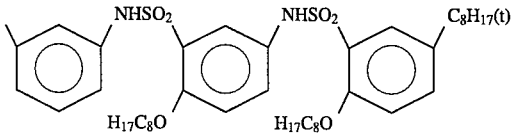 | 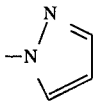 |
| M-16 | 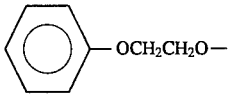 | " | 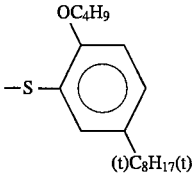 |
| M-17 | $C_2H_5O-$ | 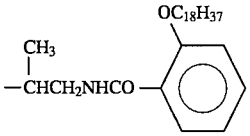 | 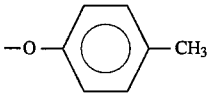 |
| M-18 | $CH_3-$ | 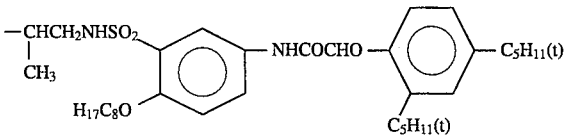 | Cl |

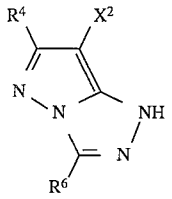
| | $R^4$ | $R^6$ | $X^2$ |
|---|---|---|---|
| m-1 | $CH_3-C(CH_3)_2-$ | $-(CH_2)_3SO_2C_{12}H_{25}$ | Cl |
| m-2 | " | $-CH(CH_3)CH_2CH_3SO_2C_{12}H_{25}$ | " |
| m-3 | " | $-C(CH_3)_2-CH_2SO_2C_{16}H_{33}$ | " |
| m-4 | " | 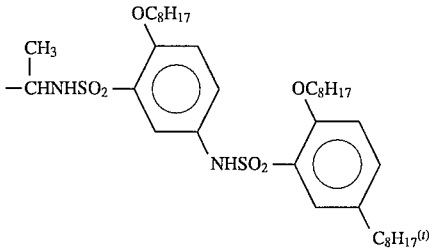 | " |
| m-5 | " | 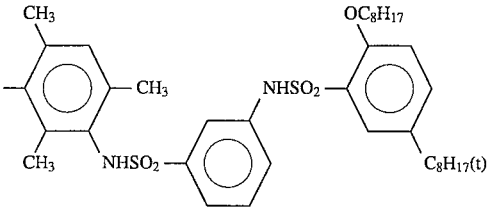 | " |
| m-6 | $CH_3-$ | $-CH(C_{12}H_{25}(n))NHCOCH_2CH_2COOH$ | Cl |
| m-7 | " | 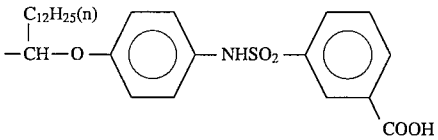 | Cl |
| m-8 | $CH_3-C(CH_3)_2-$ | 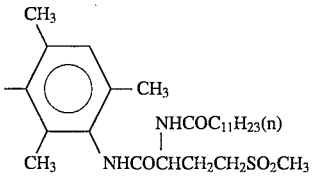 | Cl |
| m-9 | $(CH_3)_2CH-$ | 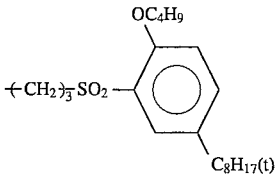 | Cl |

-continued

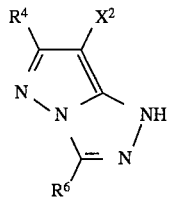

| | $R^4$ | $R^6$ | $X^2$ |
|---|---|---|---|
| m-10 | " | $-C(CH_3)_2-CH_2SO_2C_{12}H_{25}$ | $-O-C_6H_4-SO_2-C_6H_4-OH$ |
| m-11 | $C_2H_5-$ | $-CH(CH_3)-CH_2NHSO_2-C_6H_3(OC_{18}H_{37})-C_4H_9(t)$ | $-O-C_6H_4-COOCH_3$ |

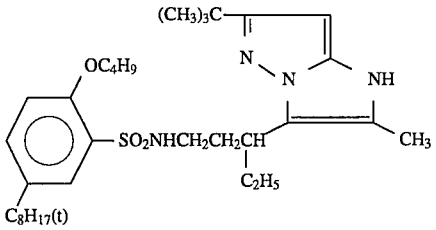

m-12

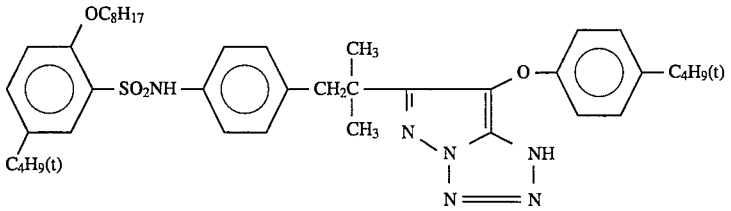

m-13

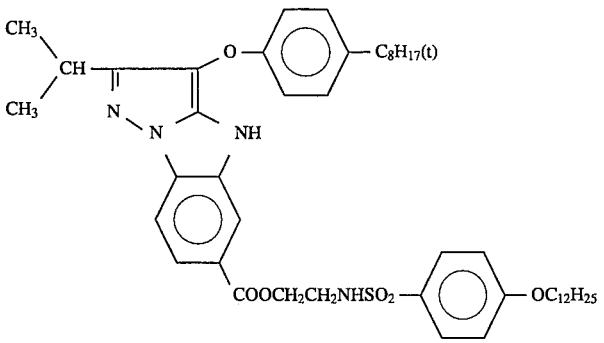

m-14

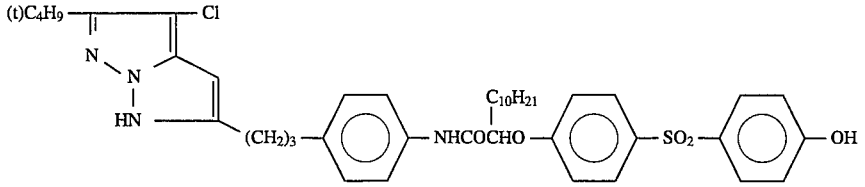

m-15

Of them, Compound C-7 is preferred.

Compounds which release a photographic useful residue on coupling can be used in the present invention. Preferred examples of DIR couplers which release a restrainer include those described in patent specifications cited in *Research Disclosure* No. 17643, Item VII-F, JP-A-57-151944, JP-A-

57-154234, JP-A-60-184248, JP-A-63-37346 and U.S. Pat. Nos. 4,248,962 and 4,782,012.

Preferred examples of couplers which imagewise release a nucleating agent or a development accelerator include those described in U.K. Patents 2,097,140 and 2,131,188, JP-A-59-157638 and JP-A-59-170840.

Examples of other compounds which can be used in the photographic material of the present invention include competitive couplers as described in U.S. Pat. No. 4,130,427; polyequivalent type couplers as described in U.S. Pat. Nos. 4,283,472, 4,338,393 and 4,310,618; DIR redox compound releasing couplers, DIR coupler releasing couplers, DIR coupler releasing redox compounds and DIR redox compound releasing redox compounds as described in JP-A-60-185950 and JP-A-62-24252; couplers which release a dye whose color is restored to the original one after elimination as described in European Patent 173,302A; bleaching accelerator releasing couplers as described in *Research Disclosure* No. 11449, *Research Disclosure* No. 24241 and JP-A-61-201247; ligand releasing couplers as described in U.S. Pat. No. 4,553,477; leuco dye releasing couplers as described in JP-A-63-75747; and fluorescent dye releasing couplers as described in U.S. Pat. No. 4,774,181.

These color couplers are generally used in an amount of 0.001 to 1 mol per mol of light-sensitive silver halide in the present invention. Preferably, the yellow couplers are used in an amount of 0.01 to 0.5 mol, the magenta couplers are used in an amount of 0.003 to 0.3 mol, and the cyan couplers are used in an amount of 0.002 to 0.3 mol.

The compounds of formula (I) used in the present invention may be used together with conventional antifading agents, whereby the effect of preventing fading can be further increased. The compounds of formula (I) may be used in combination of two or more of these compounds.

Typical examples of usable organic antifading agents for cyan, magenta and/or yellow images include hydroquinones, 6-hydroxychromans, 5-hydroxycoumarans, spiro-chromans, p-alkoxyphenols, hindered phenols such as bisphenols, gallic acid derivatives, methylenedioxybenzenes, aminophenols, hindered amines and ether and ester derivatives obtained by silylating or alkylating phenolic hydroxyl group of these compounds. Further, metal complexes such as typically (bissalicylaldoximato)nickel complex and (bis-N, N-dialkyldithiocarbamato)nickel complex can also be used.

Specific examples of suitable organic antifading agents include the hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, and U.S. Pat. Nos. 2,710,801 and 2,816,028; 6-hydroxychromans, 5-hydroxycoumarans and spiro-chromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives described in U.S. Pat. No. 3,457,079; methylenedioxybenzenes described in U.S. Pat. No. 4,332,886; aminophenols described in JP-B-56-21144; hindered amines described in U.S. Pat. Nos. 3,336,135 and 4,268,593, U.K. Patents 1,326,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and U.K. Patent 2,027,731(A). These couplers in an amount of usually 5 to 100% by weight based on the amount of the corresponding coupler are co-emulsified and added to the light-sensitive emulsion layers, thereby achieving their purpose of use.

The silver halide color photographic material of the present invention may contain hydroquinone derivatives, aminophenol derivatives, gallic acid derivatives and ascorbic derivatives as color fogging inhibitors (antifogging agents). It is more effective for ultraviolet light absorbers to be introduced into the cyan dye image forming layer and both layers adjacent thereto.

Examples of suitable ultraviolet light absorbers include aryl group-substituted benztriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A-46-2784), cinnamic ester compounds (e.g., those described in U.S. Pat. Nos. 3,705,805 and 3,707,395), butadiene compounds (e.g., those described in U.S. Pat. No. 4,045,229), benzoxazole compounds (e.g., those described in U.S. Pat. Nos. 3,406,070 and 4,271,307) and triazine compounds (e.g., those described in JP-A-46-3335). If desired, ultraviolet light absorbing couplers (e.g., α-naphthol cyan dye forming couplers) and ultraviolet light absorbing polymers may be used. These ultraviolet light absorbers may be mordanted into a specific layer. Of these compounds, aryl group-substituted benztriazole compounds are preferred.

The photographic material of the present invention comprises a support having thereon at least one layer containing at least one compound of formula (I).

Generally, the photographic material comprises a support having thereon at least one blue-sensitive silver halide emulsion layer, at least one green-sensitive silver halide emulsion layer and at least one red-sensitive silver halide emulsion layer in this order. If desired, the arrangement of the layers may be different from that described above. Further, an infrared-sensitive silver halide emulsion layer may be used in place of at least one of the above light-sensitive layers. Color reproduction by subtractive color photography can be achieved by couplers present in these light-sensitive emulsion layers, the couplers being capable of forming dyes having a color relationship complementary to light which is sensitive to silver halide emulsions having sensitivity to respective wavelength regions. Namely, a nondiffusion yellow coupler capable of forming a nondiffusion yellow dye is present in the blue-sensitive silver halide emulsion layer; a nondiffusion magenta coupler capable of forming a nondiffusion magenta dye is present in the green-sensitive silver halide emulsion layer; and a nondiffusion cyan coupler capable of forming a nondiffusion cyan dye is present in the red-sensitive silver halide emulsion layer. The light-sensitive layers does not necessarily correspond to the hue of developed color described above.

The compounds of formula (I) can be applied to, for example, color papers, reversal color papers, direct positive color photographic materials, color negative films, color positive films and reversal color films. The compounds can be advantageously applied to color photographic materials having a reflective support (e.g., color papers, reversal color papers) and color photographic materials forming a positive image (e.g., direct positive color photographic materials, color positive films, reversal color films). Particularly, the compounds can be advantageously applied to color photographic materials having a reflective support.

Any of silver chloride, silver bromide, silver chlorobromide, silver iodochlorobromide, silver iodobromide and silver iodochloride can be used as silver halides in the present invention. However, when the photographic materials are color negative films, reversal color films and reversal color papers which require high sensitivity from the standpoint of mainly photography, silver iodochlorobromide, silver iodobromide or silver iodochloride emulsion is preferred, each having a silver iodide content of 1 to 20 mol %. When photographic materials are internal latent image type direct positive color photographic materials which are not previously fogged, silver chlorobromide having a silver bromide content of 50 to 100 mol % or pure silver bromide emulsion is preferred. When the photographic materials are color papers for rapid processing, silver chlorobromide containing substantially no silver iodide and having a silver chloride content of 90 to 100 mol %, preferably 95 to 100 mol %, particularly preferably 98 to 100 mol % or a pure silver chloride emulsion is preferred.

It is preferred from the standpoint of improving the sharpness of the image, etc. that dyes decolorized by processing (particularly oxonol dyes) described in EP 0,337, 490A2 (pages 27 to 76) are added to the hydrophilic layers of the photographic materials in such an amount so as to provide an optical density of at least 0.70 at 680 nm or that at least 12 wt % (more preferably at least 14 wt %) of titanium oxide having a surface treated with a dihydric to tetrahydric alcohol (e.g., trimethylol ethane) is present in the water-resistant resin layer of the support.

It is preferred that the photographic materials used in the present invention contain dye image preservability improvers described in EP 0 277 589 A2 together with the couplers, particularly pyrazoloazole couplers.

Namely, the photographic materials contain a compound (F) described in EP 0 277 589 A2 and/or a compound (G) described in EP 0 277 589 A2, the compound (F) being chemically bonded to the aromatic amine color developing agents left behind after color development to form a compound which is chemically inert and substantially colorless, and the compound (G) being chemically bonded to the oxidation product of the aromatic amine color developing agents left behind after color development to form a compound which is chemically inert and substantially colorless. The use of the compound (F) and/or the compound (G) is preferred from the standpoint of preventing stain from being formed by developed dyes produced by the reaction with the color developing agents or the oxidation products thereof left behind in the layers during storage after processing and preventing other side effects from occurring.

Further, it is preferred that antifungal agents as described in JP-A-63-271247 are added to the photographic materials to prevent the image from being deteriorated by the growth of mildew or microbes in the hydrophilic layers.

Examples of supports for display which can be used for the photographic materials of the present invention include white polyester supports and supports having a white pigment-containing layer provided on the silver halide emulsion layer side thereof. It is preferred that an antihalation layer is coated on the silver halide emulsion layer-coated side of the support or the back side thereof to improve sharpness. It is particularly preferred that the transmission density of the support is set to from 0.35 to 0.8 so as to allow display to be observed by reflected light and transmitted light.

The photographic materials of the present invention are imagewise exposed to light, color-developed and processed with processing solutions having a bleaching ability (bleaching solution and bleaching-fixing solution). That is, in color developing, a silver halide exposed to light is reduced by a color developing agent to produce a silver, at the same time, the color developing agent oxidized reacts with a coupler to produce a dye image. Next, the silver produced in the color developing step is oxidized by a bleaching agent in the processing solution having a bleaching ability and then is dessolved by a fixing agent. Thus, only dye image can be produced. Reference can be made to *Research Disclosure* No. 17643 (pages 28 to 29) and *Research Disclosure* No. 18716 (left column to right column of page 615). For example, a color development stage, a bleaching stage, a fixing stage and a rinsing stage are conducted. A bleaching-fixing stage using a bleaching-fixing solution may be carried out in place of both the bleaching stage using a bleaching solution and the fixing stage using a fixing solution. The bleaching stage, the fixing stage and the bleaching-fixing stage may be conducted in any order. A stabilizing stage may be carried out in place of the rinsing stage, if desired. The stabilizing stage may be conducted after the rinsing stage. Further, a prehardening stage, a neutralization stage thereof, a stop-fixing stage, an after-hardening stage, a compensating stage and an intensification stage in addition to the above-described stages may be carried out. When processing is to be conducted to obtain a reversal color image, the first development is first conducted after imagewise exposure to light, reversal processing is then conducted, and the color development stage and the subsequent stages are conducted. In this case, the compensating stage is generally conducted. An intermediate rinsing stage between the above stages may be optionally conducted, if desired.

The color developing solution used in the development processing of the light-sensitive material of the present invention is an aqueous alkaline solution which contains an aromatic primary amine color developing agent as the principal component. An aminophenol compound is also useful as a color developing agent, but the use of a p-phenylenediamine compound is preferred. Typical examples of these compounds include 3-methyl-4-amino-N,N-diethylaniline, 3-methyl-4-amino-N-ethyl-N-β-hydroxyethylaniline, 4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used in combination, if desired.

Compounds of multi-valent metals such as iron(III), peracids, quinones and iron salts can be used as bleaching agents for the bleaching solution or bleach-fixing solution. Typical bleaching agents include iron chlorides; ferricyanides; bichromates; organic complex salts of iron(III), for example, complex salts of aminopolycarboxylic acids such as ethylenediamine tetraacetic acid, diethylenetriamine pentaacetic acid, or 1,3-diaminopropane tetraacetic acid; and persulfates. Among them, aminopolycarboxylic acid iron(III) complex salts are preferred from the standpoint of effectively achieving the effects of the present invention. Moreover, aminopolycarboxylic acid iron(Ill) complex salts are especially useful in both the bleaching solution and the bleach-fixing solution. The pH of the bleaching solution or bleach-fixing solution in which these aminopolycarboxylic acid iron(III) complex salts are used is normally from 3.5 to 8.

Silver halide emulsions, materials (e.g., additives), photographic constituent layers (e.g., layer arrangement), processing methods and processing additives described in the following patent specifications and European Patent 0 519 190 A2, particularly European Patent 0 355 660 A2 can be preferably applied to the present invention.

TABLES 1 TO 5

| Photographic Constituent Elements, etc. | JP-A-62-215272 | JP-A-2-33144 | EP 0 355 660 A2 |
|---|---|---|---|
| Silver halide emulsions | the 6th line of right upper column of page 10 to the 5th line of left lower column of page 12; and the 4th line from the bottom of right lower column of page 12 to the 17th line of left upper column of page 13 | the 16th line of right upper column of page 28 to the 11th line of right lower column of page 29; and the 2nd line to the 5th line of page 30 | the 53rd line of page 45 to the 3rd line of page 47; and the 20th line to the 22nd line of page 47 |
| Solvents for silver halide | the 6th line to the 14th line of left lower column of page 12; and the 3rd line from the bottom of left upper column of page 13 to the bottom of left lower column of page 18 | — | — |
| Chemical sensitizing agents | the 3rd line from the bottom of left lower column of page 12 to the 5th line from the bottom of right lower column of page 12; and the first line of right lower column of page 18 to the 9th line from the bottom of right upper column of page 22 | the 12th line to the bottom of right lower column of page 29 | the 4th line to the 9th line of page 47 |
| Spectral sensitizing agents (spectral sensitization methods) | the 8th line from the bottom of right upper column of page 22 to the bottom of page 38 | the first line to the 13th line of page 30 | the 10th line to the 15th line of page 47 |
| Emulsion stabilizers | the first line of left upper column of page 39 to the bottom of right upper column of page 72 | the 14th line of left upper column of page 30 to the first line of right upper column of page 30 | the 10th line to the 15th line of page 47 |
| Development accelerators | the first line of left lower column of page 72 to the 3rd line of right upper column page 91 | — | — |
| Color couplers (cyan, magenta, yellow couplers) | the 4th line of right upper column of page 91 to the 6th line of left upper column of page 121 | the 14th line of right upper column of page 3 to the bottom of left upper column of page 18; and the 6th line of right upper column of page 30 to the 11th line of right lower column of page 35 | the 15th line to the 27th line of page 4; the 30th line of page 5 to the bottom of page 28; the 29th line to the 31st line of page 45; and the 23rd line of page 47 to the 50th line of page 63 |
| Supersensitizing agents | the 7th line of left upper column of page 121 to the first line of right upper column of page 125 | — | — |
| Ultraviolet light absorbers | the 2nd line of right upper column of page 125 to the bottom of left lower column of page 127 | the 14th line of right lower column of page 37 to the 11th line of left upper column of page 38 | the 22nd line to the 31st line of page 65 |
| Antifading agents (image stabilization methods) | the first line of right lower column of page 127 to the 8th line of left lower column of page 137 | the 12th line of right upper column of page 36 to the 19th line of left upper column of page 37 | the 30th line of page 4 to the 23rd line of page 5; the first line of page 29 to the 25th line of page 45; the 33rd line to the 40th line of page 45; and the 2nd line to the 31st line of page 65 |
| High-boiling and/or low-boiling organic solvents | the 9th line of left lower column of page 137 to the bottom of right upper column of page 144 | the 14th line of right lower column of page 35 to the 4th line from the bottom of left lower column of page 36 | the first line to the 51st line of page 64 |
| Dispersion methods for photographic additives | the first line of left lower column of page 144 to the 7th line of right upper column of page 146 | the 10th line of right lower column of page 27 to the bottom of left upper column of page 28; and the 12th line of right lower column of page 35 to the 7th line of right upper column of page 36 | the 51st line of page 63 to the 56th line of page 64 |

TABLES 1 TO 5-continued

| Photographic Constituent Elements, etc. | JP-A-62-215272 | JP-A-2-33144 | EP 0 355 660 A2 |
|---|---|---|---|
| Hardening agents | the 8th line of right upper column of page 146 to the 4th line of left lower column of page 155 | — | — |
| Development agent precursors | the 5th line of left lower column of page 155 to the 2nd line of right lower column of page 155 | — | — |
| Restrainer releasing compounds | the 3rd line to the 9th line of right lower column of page 155 | — | — |
| Supports | the 19th line of right lower column of page 155 to the 14th line of left upper column of page 156 | the 18th line of right upper column of page 38 to the 3rd line of left upper column of page 39 | the 29th line of page 66 to the 13th line of page 67 |
| Layer structures | the 15th line of left upper column of page 156 to the 14th line of right lower column of page 156 | the first line to the 15th line of right upper column of page 28 | the 41st line to the 52nd line of page 45 |
| Dyes | the 15th line of right lower column of page 156 to the bottom of right lower column of page 184 | the 12th line of left upper column of page 38 to the 7th line of right upper column of page 38 | the 18th line to the 22nd line of page 66 |
| Color mixing inhibitors | the first line of left upper column of page 185 to the 3rd line of right lower column of page 188 | the 8th line to the 11th line of right upper column of page 36 | the 57th line of page 64 to the first line of page 65 |
| Gradation controllers | the 4th line to the 8th line of right lower column of page 188 | — | — |
| Stain inhibitors | the 9th line of right lower column of page 188 to the 10th line of right lower column of page 193 | the bottom of left upper column of page 37 to the 13th line of right lower column of page 37 | the 32nd line of page 65 to the 17th line of page 66 |
| Surfactants | the first line of left lower Column of page 201 to the bottom of right upper column of page 210 | the first line of right upper column of page 18 to the bottom of right lower column of page 24; and the 10th line from the bottom of left lower column of page 27 to the 9th line of right lower column of page 27 | — |
| Fluorine-containing compounds (antistatic agent, coating aid, lubricant anti-sticking agent, etc.) | the first line of left lower column of page 210 to the 5th line of left lower column of page 222 | the first line of left upper column of page 25 to the 9th line of right lower column of page 27 | — |
| Binders (hydrophilic colloid) | the 6th line of left lower column of page 222 to the bottom of left upper column of page 225 | the 8th line to the 18th line of right upper column of page 38 | the 23rd line to the 28th line of page 66 |
| Thickeners | the first line of right upper column of page 225 to the 2nd line of right upper column of page 227 | — | — |
| Antistatic agents | the 3rd line of right upper column of page 227 to the first line of left upper column of page 230 | — | — |
| Polymer latexes | the 2nd line of left upper column of page 230 to the bottom of page 239 | — | — |
| Matting agents | the first line of left upper column of page 240 to the bottom of right upper column of page 240 | — | — |
| Photographic processing methods (processing stages, additives, etc.) | the 7th line of right upper column of page 3 to the 5th line of right upper column of page 10 | the 4th line of left upper column of page 39 to the bottom of left upper column of page 42 | the 14th line of page 67 to the 28th line of page 69 |

TABLES 1 TO 5-continued

| Photographic Constituent Elements, etc. | JP-A-62-215272 | JP-A-2-33144 | EP 0 355 660 A2 |
|---|---|---|---|

Note: The cited parts of JP-A-62-215272 include the amendment dated March 16, 1987 attached to the end of publication. Among the above-described color couplers, short wave type yellow couplers described in JP-A-63-231451, JP-A-63-123047, JP-A-63-241547, JP-A-1-173499, JP-A-1-213648 and JP-A-1-250944 can be preferably used as yellow couplers.

The present invention is now illustrated in greater detail by reference to the following examples which, however, are not to be construed as limiting the present invention in any way.

EXAMPLE 1

Preparation of Sample 101

Both sides of a paper support were laminated with polyethylene. The surfaces of the polyethylene-laminated paper support were subjected to a corona discharge treatment. A gelatin subbing layer containing sodium dodecylbenzenesulfonate was provided on the support, and the following photographic constituent layers were coated thereon to prepare a multi-layer color photographic paper having the following layer structure. Coating solutions were prepared in the following manner.

Preparation of Coating Solution for the Fifth Layer

Thirty three g of cyan coupler (C-7), 10 g of ultraviolet light absorber (UV-2), 0.6 g of dye image stabilizer (Cpd-9), 0.6 g of dye image stabilizer (Cpd-10), 0.6 g of dye image stabilizer (Cpd-11), 0.6 g of dye image stabilizer (Cpd-8), 0.6 g of dye image stabilizer (Cpd-6), 18 g of dye image stabilizer (Cpd-1) and 57 ml of high-boiling organic solvent (Solv-3) were dissolved in 33 ml of ethyl acetate. The resulting solution was emulsified and dispersed in 270 ml of a 20% aqueous gelatin solution containing 7.0 g of sodium dodecylbenzenesulfonate by using a high-speed agitator to prepare an emulsified dispersion.

Separately, a silver chlorobromide emulsion (cubic; a 1:4 (by Ag mol) mixture of a larger-size emulsion C having a mean grain size of 0.50 μm and a smaller-size emulsion C having a mean grain size of 0.41 μm; a coefficient of variation in grain size distribution of 0.09 and 0.11, respectively; 0.8 mol % of AgBr localized on a part of the surface of the grain in each of the larger size and smaller size emulsion and the balance being silver chloride) was prepared. The following red-sensitive sensitizing dye E was added to the emulsion ($0.9\times10^{-4}$ mol of the dye was added to the larger-size emulsion and $1.1\times10^{-4}$ mol of the dye was added to the smaller-size emulsion, each amount being per mol of silver halide). Further, $2.6\times10^{-3}$ mol of the following compound F per mol of silver halide was added to the emulsion. The chemical ripening of the emulsion was carried out by adding a sulfur sensitizing agent and a gold sensitizing agent. The above emulsified dispersion and the red-sensitive silver chlorobromide emulsion were mixed and dissolved, and the coating solution for the Fifth Layer was prepared so as to give the following composition.

Coating solutions for the First Layer through the Fourth Layer, the Sixth Layer and the Seventh Layer were prepared in the same manner as in the preparation of the coating solution for the Fifth Layer. The sodium salt of 1-oxy-3,5-dichloro-s-triazine was used as the hardening agent for gelatin in each layer.

Cpd-14 and Cpd-15 were added to each layer in an amount so as to provide 25.0 mg/m$^2$ and 50.0 mg/m$^2$ in total, respectively.

The following spectral sensitizing dyes were used for the silver chlorobromide emulsion present in each light-sensitive emulsion layer.

Blue-Sensitive Emulsion Layer
Sensitizing Dye A

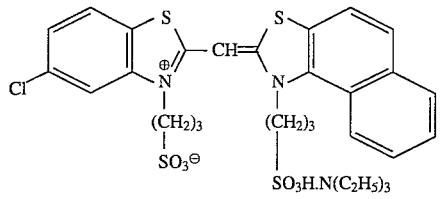

Sensitizing Dye B

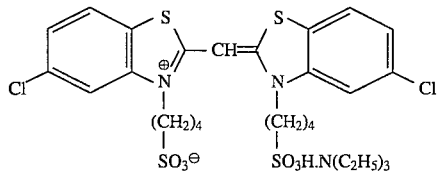

($2.0\times10^{-4}$ mol of each of the sensitizing dyes A and B was added to the larger-size emulsion A, and $2.5\times10^{-4}$ mol of each of the dyes was added to the smaller-size emulsion A, each amount being per mol of silver halide)

Green-Sensitive Emulsion Layer
Sensitizing Dye C

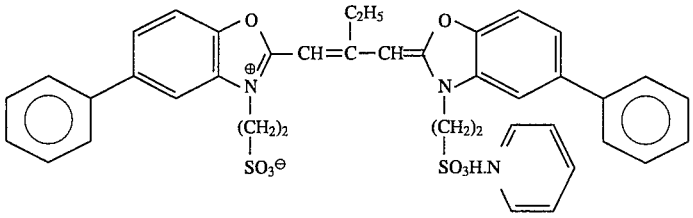

($4.0\times10^{-4}$ mol was added to the larger-size emulsion B, and $5.6\times10^{-4}$ mol was added to the smaller-size emulsion B, each amount being per mol of silver halide)

Sensitizing Dye D

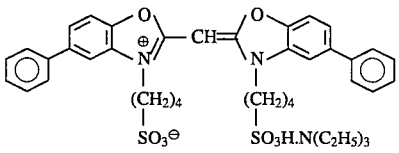

($7.0\times10^{-5}$ mol was added to the larger-size emulsion B, and $1.0\times10^{-5}$ mol was added to the smaller-size emulsion B, each amount being per mol of silver halide)

Red-Sensitive Emulsion Layer
Sensitizing Dye E

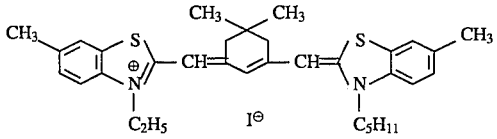

($0.9\times10^{-4}$ mol per mol of silver halide for the large-sized emulsion, and $1,1\times10^{-4}$ mol per mol of silver halide for the small-sized emulsion)

The following compound F was further added to the red-sensitive emulsion layer in an amount of $2.6\times10^{-3}$ mol per mol of silver halide.

Compound F

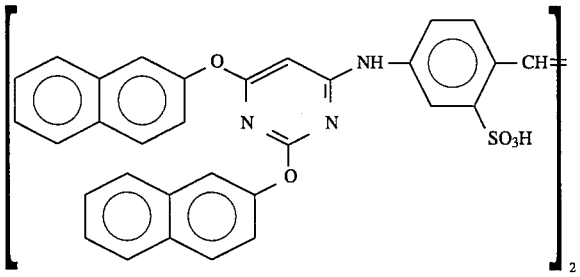

Further, $8.5\times10^{-4}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide.

Furthermore, $1\times10^{-4}$ mol and $2\times10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (numerals in parentheses are coating weights) were added to the emulsion layers to prevent irradiation.

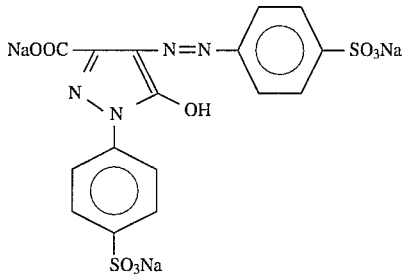

(10 mg/m²)

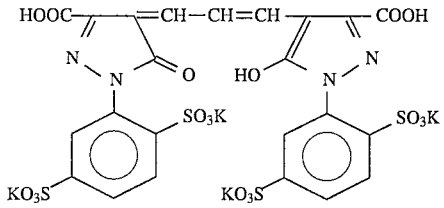

(10 mg/m²)

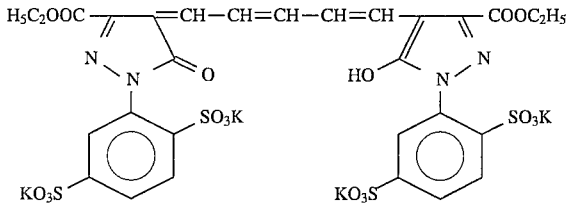

(40 mg/m²)

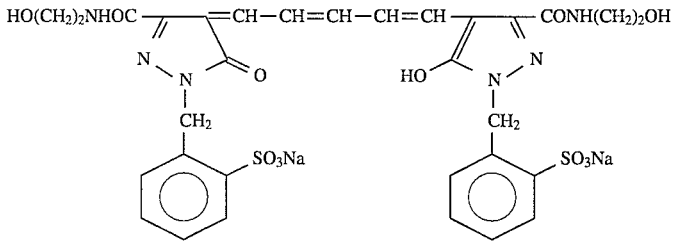

(20 mg/m²)

Layer Structure

Each layer had the following composition. The numerals represent coating weights (g/m²). The amounts of the silver halide emulsions are represented by coating weights in terms of silver.

| | |
|---|---|
| Support | |
| Polyethylene-laminated paper<br>[Polyethylene on the first layer side contained a white pigment ($TiO_2$) and bluish dye (ultramarine)] | |
| First Layer (blue-sensitive emulsion layer) | |
| Silver Chlorobromide Emulsion<br>(cubic; a 3:7 (by Ag mol) mixture of a larger-size emulsion A having a mean grain size of 0.88 μm and a smaller-size emulsion A having a mean grain size of 0.70 μm: a coefficient of variation in grain size distribution being 0.08 and 0.10, respectively, 0.3 mol % of silver bromide localized on a part of the surface of the grain in each size emulsion and the balance being silver chloride) | 0.27 |
| Gelatin | 1.36 |
| Yellow Coupler (ExY) | 0.79 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.13 |
| Solvent (Solv-2) | 0.13 |
| Second Layer (color mixing inhibiting layer) | |
| Gelatin | 1.00 |
| Color Mixing Inhibitor (Cpd-4) | 0.06 |
| Solvent (Solv-6) | 0.03 |

-continued

| | |
|---|---|
| Solvent (Solv-2) | 0.25 |
| Solvent (Solv-3) | 0.25 |
| Third Layer (green-sensitive emulsion layer) | |
| Silver Chlorobromide Emulsion (cubic; a 1:3 (by Ag mol) mixture of a larger-size emulsion B having a mean grain size of 0.55 μm and a smaller-size emulsion B having a mean grain size of 0.39 μm; a coefficient of variation in grain size distribution being 0.10 and 0.08, respectively, 0.8 mol % of AgBr localized on a part of the surface of the grain in each size emulsion and the balance being silver chloride) | 0.13 |
| Gelatin | 1.45 |
| Magenta Coupler (M-1) | 0.16 |
| Dye Image Stabilizer (Cpd-5) | 0.05 |
| Dye Image Stabilizer (Cpd-2) | 0.03 |
| Dye Image Stabilizer (Cpd-6) | 0.01 |
| Dye Image Stabilizer (Cpd-7) | 0.01 |
| Dye Image Stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (color mixing inhibiting layer) | |
| Gelatin | 0.70 |
| Color Mixing Inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (red-sensitive emulsion layer) | |
| The above silver Chlorobromide Emulsion | 0.09 |
| Gelatin | 0.85 |
| Cyan Coupler (C-7) | 0.33 |
| Ultraviolet Light Absorber (UV-2) | 0.10 |
| Dye Image Stabilizer (Cpd-1) | 0.18 |
| Dye Image Stabilizer (Cpd-6) | 0.006 |
| Dye Image Stabilizer (Cpd-8) | 0.006 |
| Dye Image Stabilizer (Cpd-9) | 0.006 |
| Dye Image Stabilizer (Cpd-10) | 0.006 |
| Dye Image Stabilizer (Cpd-11) | 0.006 |
| Solvent (Solv-3) | 0.66 |
| Sixth Layer (ultraviolet light absorbing layer) | |
| Gelatin | 0.85 |
| Ultraviolet Light Absorber (UV-1) | 0.65 |
| Dye Image Stabilizer (Cpd-12) | 0.15 |
| Dye Image Stabilizer (Cpd-5) | 0.02 |
| Seventh Layer (protective layer) | |
| Gelatin | 1.13 |
| Acrylic-modified Copolymer of Polyvinyl Alcohol (degree of modification: 17%) | 0.05 |
| Liquid Paraffin | 0.02 |
| Dye Image Stabilizer (Cpd-13) | 0.01 |

(ExY) Yellow Coupler

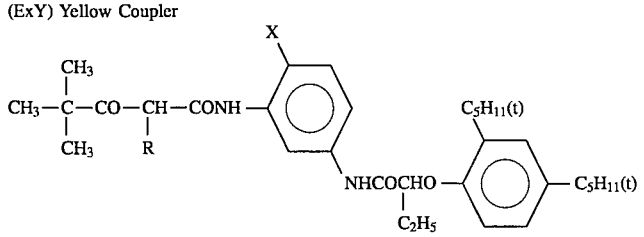

R = 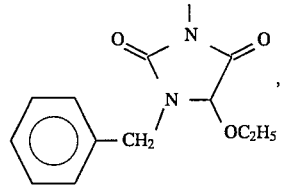 , X = Cl

R = 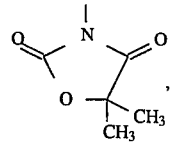 , X = $OCH_3$

-continued
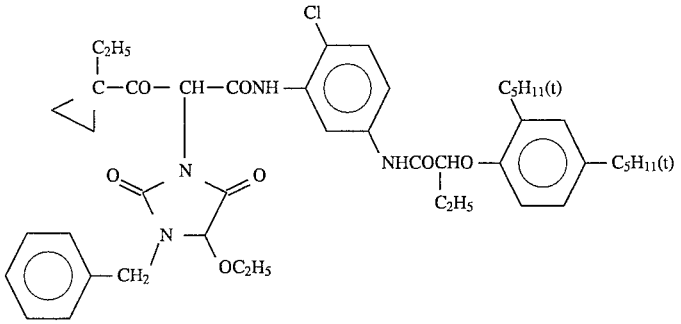
1:1:1 Mixture (by mol)
(Cpd-1) Dye Image Stabilizer
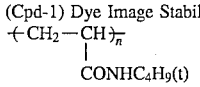
(Average MW = 60,000)
(Cpd-2) Dye Image Stabilizer
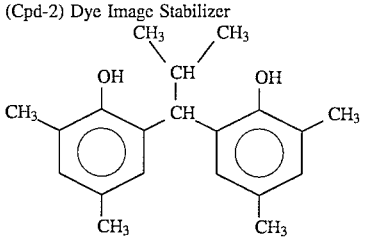
(Cpd-3) Dye Image Stabilizer
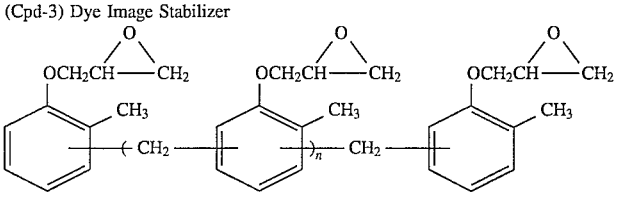
n = 7~8 (mean value)
(Cpd-4) Color Mixing Inhibitor
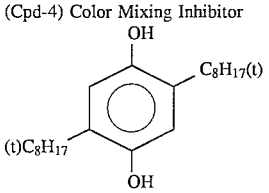
(Cpd-5) Dye Image Stabilizer
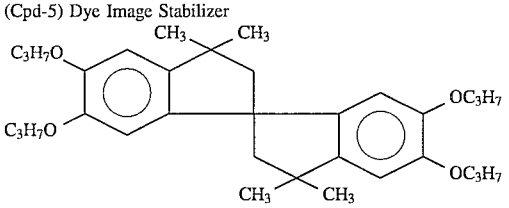
(Cpd-6) Dye Image Stabilizer
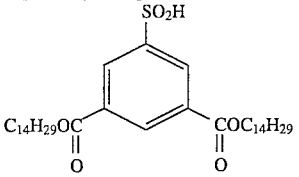
(Cpd-7) Dye Image Stabilizer -continued
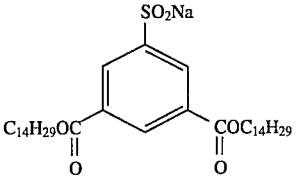
(Cpd-8) Dye Image Stabilizer
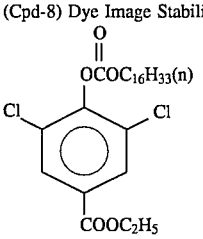
(Cpd-9) Dye Image Stabilizer
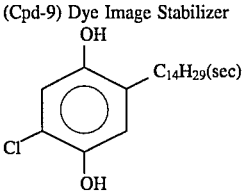
(Cpd-10) Dye Image Stabilizer
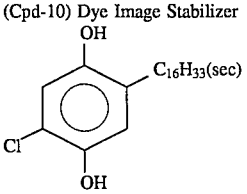
(Cpd-11) Dye Image Stabilizer
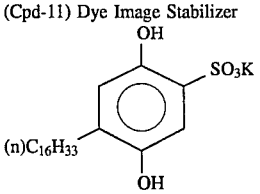
(Cpd-12) Dye Image Stabilizer
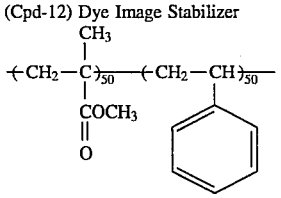
Average MW = 60,000
(Cpd-13) Dye Image Stabilizer
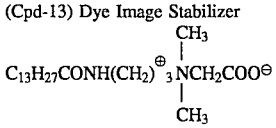
(Cpd-14) Antiseptic
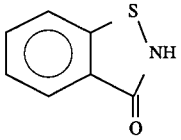
(Cpd-15) Antiseptic -continued
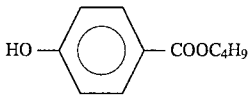
(Solv-1) Solvent
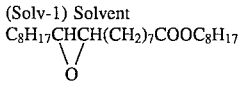
(Solv-2) Solvent
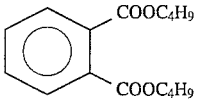
(Solv-3) Solvent
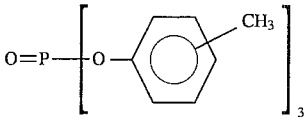
(Solv-4) Solvent
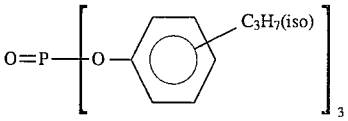
(Solv-5) Solvent
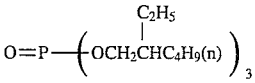
(Solv-6) Solvent
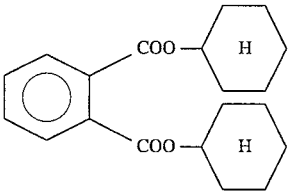
(Solv-7) Solvent
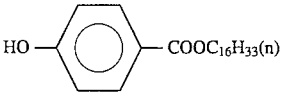
(UV-1) Ultraviolet Light Absorber
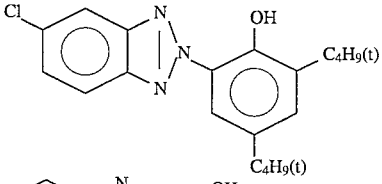
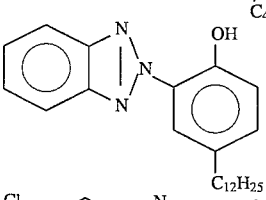
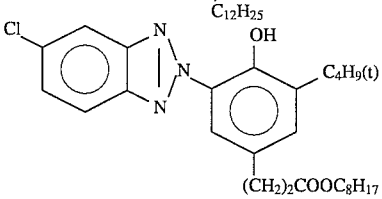

-continued

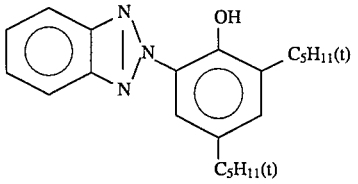

1:5:10:5 Mixture (by weight)

(UV-2) Ultraviolet Light Absorber

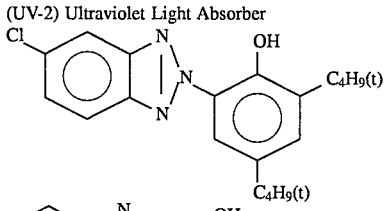

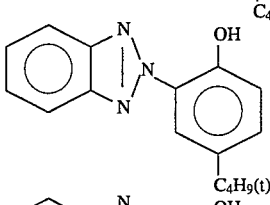

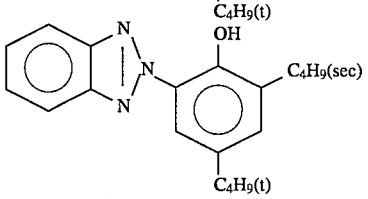

1:2:2 Mixture (by weight)

Preparation of Samples 102 to 129

Samples 102 to 129 were prepared in the same manner as in the preparation of the Sample 101 except for the following changes. Couplers and high-boiling organic solvents as shown in Table 6 below were used in place of the coupler and the high-boiling organic solvent used in Sample 101 in the preparation of the emulsified dispersion used in the preparation of the coating solution for the Fifth Layer. In the preparation of Sample 102, the amount of the high-boiling organic solvent used was twice as much as that used in the preparation of Sample 101. In the preparation of Samples 103 to 117, 119, 120, 121, 123 to 125 and 127 to 129, the compounds shown in Table 6 below in an equal amount by weight to that of the high-boiling organic solvent were used. Coating solutions were prepared in the same manner as in preparation of Sample 101 to prepare Samples 102 to 129.

The coupler was used in an equimolar amount to the amount of C-7 used in Sample 101.

CS-1, CS-2, CS-3 and CS-4 were used as comparative compounds.

CS-1

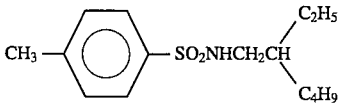

(Compound described in EP 0309159A1)

CS-2

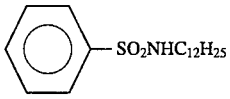

-continued (Compound described in EP 0309159A1)

CS-3

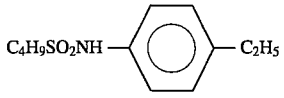

(Compound described in EP 0309159A1)

CS-4

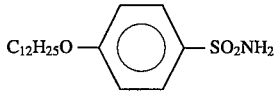

(Compound described in JP-A-4-346338)

Each sample was subjected to gradation exposure to light through a red filter for sensitometry by using a sensitometer (FWH type, color temperature of light source: 3200° K., a product of Fuji Photo Film Co., Ltd.). Exposure was conducted so that the exposure time was 0.1 sec and the exposure amount was 250 CMS.

The exposed samples were subjected to continuous processing (running test) in the following stages with the following processing solutions using a test paper processor until the amount of the replenisher of the color developing solution used reached twice the tank capacity.

| Processing Stage | Temp. (°C.) | Time (sec) | Replenisher* (ml) | Tank Solution (l) |
|---|---|---|---|---|
| Color Development | 35 | 45 | 161 | 1 |
| Bleaching-Fixing | 35 | 45 | 215 | 1 |
| Stabilization (1) | 35 | 20 | — | 0.6 |

-continued

| Processing Stage | Temp. (°C.) | Time (sec) | Replenisher* (ml) | Tank Solution (l) |
|---|---|---|---|---|
| Stabilization (2) | 35 | 20 | — | 0.6 |
| Stabilization (3) | 35 | 20 | — | 0.6 |
| Stabilization (4) | 35 | 20 | 248 | 0.6 |
| Drying | 80 | 60 | | |

*Replenisher amount being per $m^2$ of the photographic material.

The stabilization stage was a four tank countercurrent system of from (4) to (1).

Each processing solution had the following composition.

| | Tank Solution | Replenisher |
|---|---|---|
| **Color Developing Solution** | | |
| Water | 800 ml | 800 ml |
| 1-Hydroxyethylidene-1,1-diphosphonic Acid (60% aq. soln) | 0.8 ml | 0.8 ml |
| Lithium Sulfate (anhydrous) | 2.7 g | — |
| Triethanolamine | 8.0 g | 8.0 g |
| Sodium Chloride | 1.4 g | — |
| Potassium Bromide | 0.03 g | 0.025 g |
| Diethylhydroxyamine | 4.6 g | 7.2 g |
| Potassium Carbonate | 27 g | 27 g |
| Sodium Sulfite | 0.1 g | 0.2 g |
| N-Ethyl-N-(β-methanesulfonamidoethyl)-3-methyl-4-aminoaniline 3/2 Sulfate Monohydrate | 4.5 g | 7.3 g |
| Fluorescent Brightener (4,4'-diaminostilbene compound) | 2.0 g | 3.0 g |
| Water to make | 1000 ml | 1000 ml |
| pH (adjusted by adding potassium hydroxide) | 10.25 | 10.80 |
| **Bleaching-Fixing Solution** | | |
| Tank solution and replenisher with the same. | | |
| Water | | 400 ml |
| Ammonium Thiosulfate (700 g/liter) | | 100 ml |
| Sodium Sulfite | | 17 g |
| Ammonium Ethylenediaminetetraacetato Ferrate | | 55 g |
| Disodium Ethylenediaminetetraacetate | | 5 g |
| Glacial Acetic Acid | | 9 g |
| Water to make | | 1000 ml |

-continued

| | Tank Solution | Replenisher |
|---|---|---|
| pH (25° C.) | | 5.40 |
| **Stabilizing Solution** | | |
| Tank solution and replenisher were the same. | | |
| Benzisothiazoline-3-one | | 0.02 g |
| Polyvinyl Pyrrolidone | | 0.05 g |
| Water to make | | 1000 ml |
| pH (25° C.) | | 7.40 |

Evaluation of Sample

After processing, the absorption spectrum of each sample was measured with a spectrophotometer (UM 365, a product of Shimadzu Seisakusho Ltd.). The absorption spectrum of the area where absorbance at the maximum absorption wavelength was 1.0 was measured. The magnitude $D_{600nm}$ of absorbance of the spectrum at 600 nm is referred to as the criterion of the magnitude of the association. A smaller $D_{600nm}$ value means that the degree of association is smaller.

The maximum color density ($D_{max}$) of each of the processed samples was measured with red light.

Further, each of the processed samples was subjected to a fading test using a xenon light (80,000 1×) for 3 weeks. The fading ratio (%) of cyan dye at an initial density of 1.0 was measured. The fading ratio is the ratio of the density after fading to the initial density. A smaller value means that the degree of fading is smaller.

The results of $D_{600nm}$, $D_{max}$ and the fading ratio obtained are shown in Table 6 below.

TABLE 6

| Sample | Coupler | High-Boiling Organic Solvent | Additive | $D_{600\ nm}$ | $D_{max}$ | Fading Ratio | Remarks |
|---|---|---|---|---|---|---|---|
| 101 | C-7 | Solv-3 | — | 88.8 | 2.25 | 24.1 | Comp. Ex. |
| 102 | " | " | — | 81.3 | 2.31 | 23.8 | " |
| 103 | " | " | CS-1 | 81.9 | 2.32 | 37.2 | " |
| 104 | " | " | CS-2 | 80.0 | 2.31 | 36.9 | " |
| 105 | " | " | CS-3 | 81.6 | 2.29 | 22.1 | " |
| 106 | " | " | CS-4 | 72.2 | 2.24 | 36.0 | " |
| 107 | " | " | S-1 | 69.5 | 2.36 | 12.0 | Invention |
| 108 | " | " | S-3 | 69.8 | 2.36 | 12.3 | " |
| 109 | " | " | S-5 | 68.7 | 2.36 | 15.5 | " |
| 110 | " | " | S-20 | 70.3 | 2.33 | 14.9 | " |
| 111 | " | " | S-21 | 70.2 | 2.34 | 14.8 | " |
| 112 | " | " | S-25 | 67.4 | 2.34 | 13.5 | " |
| 113 | " | " | S-28 | 69.2 | 2.34 | 15.0 | " |
| 114 | " | " | S-35 | 69.4 | 2.36 | 17.2 | " |
| 115 | " | " | S-41 | 69.8 | 2.34 | 15.5 | " |
| 116 | " | " | S-43 | 69.5 | 2.36 | 14.0 | " |
| 117 | C-7 | Solv-3 | S-45 | 70.8 | 2.27 | 20.5 | Invention |
| 118 | " | Solv-2 | — | 98.6 | 2.15 | 25.2 | Comp. Ex. |
| 119 | " | " | S-1 | 77.6 | 2.32 | 13.6 | Invention |
| 120 | " | " | S-3 | 79.3 | 2.32 | 13.8 | " |

TABLE 6-continued

| Sample | Coupler | High-Boiling Organic Solvent | Additive | $D_{600\ nm}$ | $D_{max}$ | Fading Ratio | Remarks |
|---|---|---|---|---|---|---|---|
| 121 | " | " | S-21 | 78.7 | 2.31 | 15.6 | " |
| 122 | C-8 | Solv-3 | — | 80.4 | 2.27 | 23.9 | Comp. Ex. |
| 123 | " | " | S-1 | 65.9 | 2.36 | 11.9 | Invention |
| 124 | " | " | S-3 | 67.6 | 2.35 | 12.0 | " |
| 125 | " | " | S-21 | 67.4 | 2.30 | 14.4 | " |
| 126 | C-21 | " | — | 81.5 | 2.31 | 24.3 | Comp. Ex. |
| 127 | " | " | S-1 | 69.2 | 2.36 | 12.4 | Invention |
| 128 | " | " | S-3 | 70.7 | 2.36 | 12.6 | " |
| 129 | " | " | S-21 | 70.5 | 2.34 | 14.2 | " |

In the preparation of Sample 102, the amount of Solv-3 used was twice as much as that used in the preparation of Sample 101.

It can be seen from the results shown in Table 6 as sown below.

Comparative compounds CS-1 to CS-3 have no effect on preventing the association and have higher fading rate compared to those of the present invention. Comparative compound CS-4 described in JP-A-4-346338 inhibits the occurrence of association to some extent, however, the fading rate is higher than that of the present invention.

When the samples contain the compounds of the present invention, the $D_{600nm}$ value are small and hence the occurrence of association can be inhibited. Further, it can be seen that when the samples contain the compounds of the present invention, $D_{max}$ can be increased and hence good developability can be obtained. Furthermore, the fading ratio is low and hence fastness is superior.

EXAMPLE 2

Preparation of Samples 201 to 217

Sample 201 was prepared in the same manner as in the preparation of Sample 101.

Sample 202 was prepared in the same manner as in the preparation of Sample 201 except that the amount of the high-boiling organic solvent was reduced to half of the amount used in the preparation of Sample 201 in the preparation of the emulsified dispersion used in the preparation of the coating solution for the Third Layer. Samples 203 to 217 were prepared in the same manner as in the preparation of Sample 101 except that additives shown in Table 7 below in an equal amount by weight to that of the high-boiling organic solvent were added in the preparation of the emulsified dispersion used in the preparation of the coating solution for the Third Layer.

Samples 201 to 217 were subjected to gradation exposure to light through a green filter for sensitometry by using the same sensitometer used in Example 1. Exposure was conducted so that the exposure time was 0.1 sec and the exposure amount 250 CMS.

The exposed samples were developed and processed in the same manner as in Example 1.

Evaluation of Samples

After processing, the absorption spectrum of each sample was measured with a spectrophotometer (UM 365, a product of Shimadzu Seisakusho Ltd.). The absorption spectrum of the area where absorbance at the maximum absorption wavelength is 1.0 was measured. The magnitude $D_{500nm}$ of absorbance of the spectrum at 500 nm is referred to as the criterion of the magnitude of association. A smaller $D_{500nm}$ value means that the degree of association is smaller.

The maximum color density ($D_{max}$) of each of the processed samples was measured with green light.

Further, the processed samples were subjected to a fading test using a xenon light (80,000 1×) for three weeks. The fading ration (%) of magenta dye at an initial density of 1.0 was measured. The fading ratio is the ratio of the density after fading to the initial density. A smaller value means that the degree of fading is smaller.

The results of $D_{500nm}$, $D_{max}$ and the fading ratio obtained are shown in Table 7 below.

TABLE 7

| Sample | Additive | $D_{500\ nm}$ | $D_{max}$ | Fading Ratio | Remarks |
|---|---|---|---|---|---|
| 201 | — | 81.3 | 2.31 | 14.8 | Comp. Ex. |
| 202 | — | 92.5 | 2.26 | 15.6 | " |
| 203 | CS-1 | 81.9 | 2.32 | 36.8 | " |
| 204 | CS-2 | 80.2 | 2.31 | 32.2 | " |
| 205 | CS-3 | 86.5 | 2.27 | 18.1 | " |
| 206 | CS-4 | 76.7 | 2.23 | 35.2 | " |
| 207 | S-1 | 74.1 | 2.34 | 11.4 | Invention |
| 208 | S-3 | 74.7 | 2.33 | 11.6 | " |
| 209 | S-5 | 73.7 | 2.33 | 12.8 | " |
| 210 | S-20 | 73.9 | 2.33 | 13.7 | " |
| 211 | S-21 | 73.3 | 2.34 | 13.8 | " |
| 212 | S-25 | 73.5 | 2.36 | 12.9 | " |
| 213 | S-28 | 75.3 | 2.34 | 14.2 | " |
| 214 | S-35 | 74.2 | 2.36 | 14.0 | " |
| 215 | S-41 | 74.4 | 2.34 | 13.2 | " |
| 216 | S-43 | 73.5 | 2.36 | 13.7 | " |
| 217 | S-45 | 75.7 | 2.28 | 20.3 | " |

In the preparation of Sample 202, the amount of Solv-3 was used twice as much as that used in the preparation of Sample 201.

It can be seen from the results shown in Table 7 that when the samples contain the compounds of the present invention, $D_{500nm}$ values are small and hence the occurrence of association can be inhibited. Further, it can be seen that when the samples contain the compounds of the present invention, $D_{max}$ can be increased and hence good developability can be obtained. Furthermore, the fading ratio is low and hence fastness is superior.

EXAMPLE 3

Sample 301 was prepared in the same manner as in the preparation of Sample 101 except that high-boiling organic solvent (solv-3) was replaced with an equal weight of compound S-1 and emulsified and dispersed. Sample 301 was evaluated in the same manner as in Example 1.

It turned out that Sample 301 shows superior results in color reproducibility, inhibitation of the association and fading property to the light compared to Sample 107 in Example 1.

Thus, the compounds of the present invention can be a dispersion medium itself so that photographic additives can be dispersed therein even if a high-boiling solvent is not used as a dispersion medium. The sole use of the compounds of the present invention as a dispersion medium shows a superior result compared to the combined use with the other high-boiling organic solvent.

It can be seen from the above that according to the present invention a silver halide color photographic material which has good color reproducibility, does not suffer from fading and is excellent in developability can be obtained.

While the present invention has been described in detail and with reference to specific embodiments thereof, it is apparent to one skilled in the art that various changes and modifications can be made therein without departing from the spirit and the scope of the present invention.

What is claimed is:

1. A silver halide color photographic material capable of being processed with a processing solution having a bleaching ability after imagewise exposure to light and color development, wherein the silver halide color photographic material comprises a support having thereon a silver halide emulsion layer and at least one layer containing at least one compound represented by formula (I) in an amount of 0.0002 to 20 g per $m^2$ of said photographic material:

$$R^1—SO_2NH_2 \quad (I)$$

wherein $R^1$ represents an unsubstituted aliphatic group having 6 or more carbon atoms, an unsubstituted aryl group or an aryl group substituted by at least one substituent selected from the group consisting of an aliphatic group, an aryloxy group, a carbamoyl group, an acylamino group, an aliphatic oxycarbonyl group, an aryloxycarbonyl group and a halogen atom provided that $R^1$ does not contain any coupler residue.

2. The silver halide color photographic material as in claim 1, wherein the silver halide color photographic material comprises a support having thereon at least one layer containing at least one compound of formula (I), whereby association of dyes formed on imagewise exposure color developing and processing with a solution having a bleaching ability is prevented from occurring.

3. The silver halide color photographic material as in claim 1, wherein the layer containing at least one compound of formula (I) contains at least one cyan coupler represented by the following formula (III) or at least one magenta coupler represented by the following formula (IV)

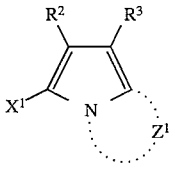

(III)

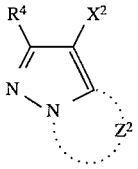

(IV)

wherein $Z^1$ and $Z^2$ each represents a non-metallic atomic group required for forming an azole ring together with a nitrogen atom as the hereto-atom of the ring; $R^2$ and $R^3$ each represents an electron withdrawing group having a Hammett's substituent constant $\sigma_p$ of at least 0.30; $R^4$ represents a hydrogen atom or a substituent; and $X^1$ and $X^2$ each represents a hydrogen atom or a group which is eliminated on coupling reaction with the oxidation product of an aromatic primary amine color developing agent.

4. The silver halide color photographic material as in claim 1, wherein said compound represented by formula (I) disperses a dye-forming nondiffusion coupler.

5. The silver halide color photographic material as in claim 1, wherein said compound represented by formula (I) is a compound represented by formula (II)

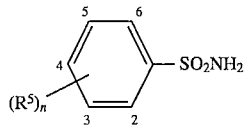

(II)

wherein $R^5$ represents an aliphatic group, an aryloxy group, a carbamoyl group, an acylamino group, an aliphatic oxycarbonyl group, an aryloxycarbonyl group or a halogen atom; and n represents an integer of 1 to 5 and when n is 2 to 5, two or more $R^5$ groups may be the same or different provided that $R^5$ does not contain any coupler residue.

6. The silver halide color photographic material as in claim 5, wherein $R^5$ is a aliphatic oxycarbonyl group or an aryloxycarbonyl group and n is 1 or 2.

7. The silver halide color photographic material as in claim 6, wherein n is 1 and $R^5$ is attached to the 2-position or the 3-position.

8. The silver halide color photographic material as in claim 6, wherein n is 2 and $R^5$'s are attached to the 3-position and the 5-position.

9. The silver halide color photographic material as in claim 5, wherein $R^5$ is an aliphatic group, an aliphatic carbamoyl group, an aliphatic acylamino group or an aliphatic oxycarbonyl group.

10. The silver halide color photographic material as in claim 9, wherein $R^5$ is an aliphatic carbamoyl group, an aliphatic acylamino group or an aliphatic oxycarbonyl group.

11. The silver halide color photographic material as in claim 5, wherein n is 1 or 2.

12. The silver halide color photographic material as in claim 11, wherein n is 2.

13. The silver halide color photographic material as in claim 1, wherein said compound represented by formula (I) is present in at least one hydrophilic colloid layer.

14. The silver halide color photographic material as in claim 1, wherein said compound represented by formula (I) is present in a silver halide emulsion layer containing at least one dye-forming nondiffusion coupler.

15. The silver halide color photographic material as in claim 3, wherein a color coupler is used in an amount of 0.001 to 1 mol per mol of light-sensitive silver halide.

16. The silver halide color photographic material as in claim 1, wherein the silver halide emulsion layer and the at least one layer containing at least one compound represented by formula (I) are the same layer.

17. A color image forming method which comprises imagewise exposing a silver halide color photographic material comprising a support having thereon at least one layer containing an amount of 0.0002 to 20 g per $m^2$ at least one compound of formula (I)

$$R^1—SO_2NH_2 \quad (I)$$

wherein $R^1$ represents an unsubstituted aliphatic group having 6 or more carbon atoms, an unsubstituted aryl group or an aryl group substituted by at least one substituent selected from the group consisting of an aliphatic group, an aryloxy group, a carbamoyl group, an acylamino group, an aliphatic oxycarbonyl group, an aryloxycarbonyl group and a halogen atom provided that $R^1$ does not contain any coupler residue; color developing the imagewise exposed silver halide color photographic material with an aromatic primary color developing agent; and then processing the silver halide color photographic material with a solution having a bleaching ability.

18. The color image forming method as in claim 17, wherein said compound represented by formula (I) disperses a dye-forming nondiffusion coupler.

* * * * *